US011815322B2

(12) United States Patent
Macy

(10) Patent No.: US 11,815,322 B2
(45) Date of Patent: Nov. 14, 2023

(54) METHOD AND APPARATUS FOR PROVIDING A MODULE FOR FIREARM MODIFICATION VIA AN EXISTING FIRING CONTROL UNIT

(71) Applicant: Black Site, Inc., Houston, TX (US)

(72) Inventor: Omar Alonso Macy, Houston, TX (US)

(73) Assignee: Black Site Inc., Houston, TX (US)

( * ) Notice: Subject to any disclaimer, the term of this patent is extended or adjusted under 35 U.S.C. 154(b) by 0 days.

(21) Appl. No.: 17/361,078

(22) Filed: Jun. 28, 2021

(65) Prior Publication Data

US 2021/0325136 A1 Oct. 21, 2021

Related U.S. Application Data

(63) Continuation-in-part of application No. 15/900,524, filed on Feb. 20, 2018, now Pat. No. 11,047,639, which is a continuation-in-part of application No. 15/892,410, filed on Feb. 9, 2018, now abandoned, and a continuation-in-part of application No. 15/892,397, filed on Feb. 8, 2018, now abandoned.

(60) Provisional application No. 62/456,499, filed on Feb. 8, 2017, provisional application No. 62/456,490, filed on Feb. 8, 2017.

(51) Int. Cl.
*F41A 19/15* (2006.01)
*F41C 23/10* (2006.01)

(52) U.S. Cl.
CPC ..... *F41A 19/15* (2013.01); *F41C 23/10* (2013.01)

(58) Field of Classification Search
CPC ..... F41A 19/10; F41A 19/12; F41A 19/15; F41A 19/31; F41A 11/02; F41C 23/12; F41C 23/22; F41C 27/22
USPC ..... 42/69.01, 69.02, 69.03
See application file for complete search history.

(56) References Cited

U.S. PATENT DOCUMENTS

2009/0071053 A1* 3/2009 Thomele ..... F41A 11/02 42/70.08
2018/0100712 A1* 4/2018 Tompkins ..... F41A 19/10

* cited by examiner

*Primary Examiner* — Bret Hayes
(74) *Attorney, Agent, or Firm* — JW Law Group; James M. Wu

(57) ABSTRACT

A firearm assembly, capable of firing bullets, includes a firearm assembly kit and a firing control unit ("FCU"). The FCU, in one embodiment, is disassembled from a handgun which is operable by one hand and capable of initiating firing a bullet when a trigger of the FCU is pulled. The firearm assembly kit is configured to house the FCU to form an operable firearm resembling a semiautomatic rifle operable by two hands. The kit includes a grip module and an extended firing slide ("EFS"). The grip module includes a handgrip, an FCU housing, a trigger guard, and a magazine port, wherein the trigger guard is situated between the handgrip and the magazine port which is located in front of the handgrip away from the user. The EFS facilitates firing of bullets from a magazine inserted in the magazine port via an extended firing pin.

22 Claims, 26 Drawing Sheets

METHOD AND APPARATUS FOR PROVIDING A MODULE FOR FIREARM MODIFICATION VIA AN EXISTING FIRING CONTROL UNIT

PRIORITY

This application is a continuation-in-part of U.S. patent application Ser. No. 15/900,524, filed on Feb. 20, 2018 in the name of the same inventor and entitled "Method and Grip Module for Firearm Modification Using A Firing Control Unit," issued into a U.S. Pat. No. 11,047,639, which is a continuation-in-part of U.S. patent application Ser. No. 15/892,397, filed on Feb. 8, 2018 in the name of the same inventor and entitled "Method and Apparatus for Providing a Grip Module able to House a Firing Control Unit," which further claims the benefit of priority based upon U.S. Provisional Patent Application Ser. No. 62/456,490, filed on Feb. 8, 2017 in the name of the same inventor and entitled "Firearm Grip Module," and U.S. Provisional Patent Application Ser. No. 62/456,499, filed on Feb. 8, 2017 in the name of the same inventor and entitled "Firearm Grip Module Conversion."

The U.S. patent application Ser. No. 15/900,524 is also a continuation-in-part of U.S. patent application Ser. No. 15/892,410, filed on Feb. 9, 2018 in the name of the same inventor and entitled "Method and Grip Module for Firearm Modification Using a Firing Control Unit."

All of which are incorporated herein by reference in their entirety.

FIELD

The embodiments of present invention relate to firearms. More specifically, the present invention relates to firearm kits and existing FCUs.

BACKGROUND

A conventional gun, such as a rifle and/or pistol containing a striker is able to strike the casing of ammunition to ignite the primer and discharge the projectile. For example, when a trigger of pistol is pulled, the sear releases the striker, allowing the striker spring to displace the striker forward so that the striker strikes the ammunition to launch a bullet. Typically, the guns include different types of firearms which include, but not limited to, semiautomatic rifles (i.e., Ruger SR-556, Smith & Wesson M&P15-22, CMMG Mk47 Mutant), bullpup firearms (i.e., Kel-Tec KSG, Kel-Tec RDB, M17S556), and/or machine guns (i.e., TEC 9, NP9, Honey Badger PDW).

A problem associated with the conventional guns is that the components of the different types of the guns are not interchangeable.

SUMMARY

A firearm assembly, capable of firing bullets, includes a firearm assembly kit and a firing control unit ("FCU"). The FCU, in one embodiment, is disassembled from a handgun which is operable by one hand and capable of initiating firing a bullet when a trigger of the FCU is pulled. The firearm assembly kit is configured to house the FCU to form an operable firearm resembling a semiautomatic rifle operable by two hands. The kit includes a grip module and an extended firing slide ("EFS"). The grip module includes a handgrip, an FCU housing, a trigger guard, and a magazine port, wherein the trigger guard is situated between the handgrip and the magazine port which is located in front of the handgrip away from a user. The EFS facilitates firing of bullets passing through a magazine inserted in the magazine port via an extended firing pin in accordance with the FCU firing mechanism.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1:
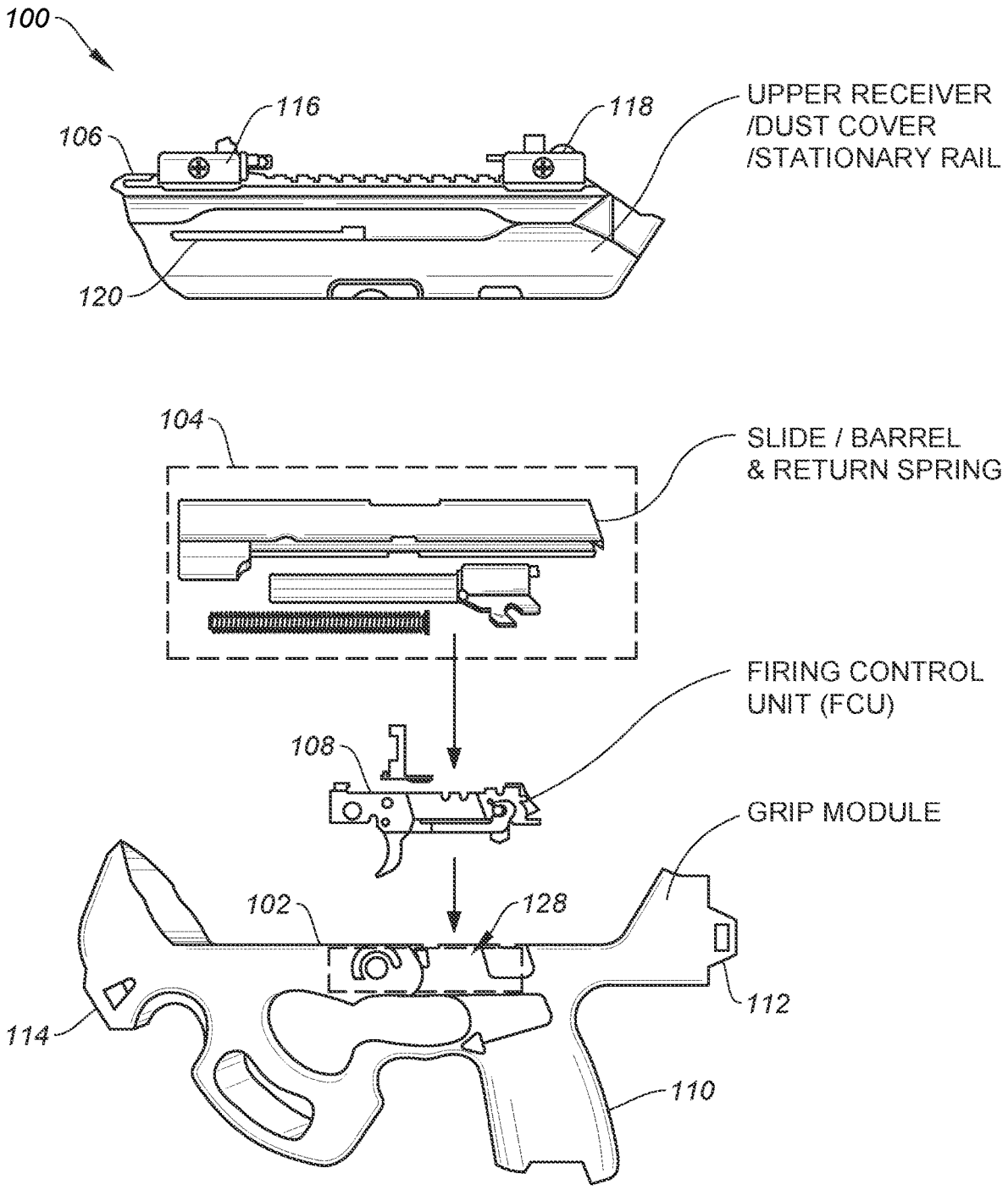
FIG. 1 is a diagram illustrating a grip module and FCU in accordance with one embodiment of the present invention.

Exemplary embodiment(s) of the present invention is described herein in the context of a method, system and apparatus of modifying a firearm using a grip module or a firearm kit via an existing FCU.

Those of ordinary skills in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

One embodiment of the presently claimed invention discloses a modified firearm or a firearm assembly capable of firing bullets. The firearm assembly includes a firearm assembly kit and a firing control unit ("FCU"). The FCU, in one embodiment, is disassembled from a handgun which is operable by one hand and capable of initiating firing a bullet when a trigger of the FCU is pulled. The firearm assembly kit is configured to house the FCU to form an operable firearm resembling a semiautomatic rifle operable by two hands. The kit includes a grip module and an extended firing slide ("EFS"). The grip module includes a handgrip, an FCU housing, a trigger guard, and a magazine port, wherein the trigger guard is situated between the handgrip and the magazine port which is located in front of the handgrip away from a user. The EFS facilitates firing of bullets passing through a magazine inserted in the magazine port via an extended firing pin.

In an alternative embodiment, a firearm assembly resembling a bullpup-shaped rifle ("BSR") or ArmaLite rifle ("AR") is assembled using a kit and an existing FCU. The BSR or AR shaped assembly is able to expel an object such as a bullet. In some embodiments, the BSR includes an FCU, grip module, bullpup rear attachment, and bolt and barrel assembly. The FCU is a serialized trigger mechanism capable of initiating launching a directional object when a trigger of the FCU is pulled. The grip module which contains a grip, FCU housing, and rear stabilizing connector, wherein the FCU housing is configured to house a removable FCU. The bullpup rear attachment which is coupled to the rear stabilizing connector for enhancing stability is configured to have a magazine port for receiving a magazine. The bolt and barrel assembly which is situated above the magazine port inside of the bullpup rear attachment behind the FCU facilitates the firing of the object. In one aspect, the BSR also includes an upper receiver configured to couple to the grip module for enclosing the FCU and the bolt and barrel assembly between the upper receiver and the grip module.

FIG. 1 is a diagram 100 illustrating a grip module and FCU in accordance with one embodiment of the present invention. Diagram 100, in some embodiments, includes a grip module 102, FCU 108, internal components 104, and upper receiver 106. Internal components 104 includes, but not limited to, a slide, a barrel, a barrel block, a bolt, and/or return spring. Grip module 102, in one example, can also be referred to as bottom receiver or lower receiver. It should be noted that the underlying concept of the exemplary embodiment(s) of the present invention would not change if one or more components (or elements) were added to or removed from diagram 100.

Grip module 102, in some embodiments, includes a handle or grip 110, an FCU housing 128, a rear stabilizing connector 112, and a trunnion 114. Grip 110 can be resized to better accommodate smaller or larger hands of a user. In one example, grip 110 is configured to be hollow capable of receiving a magazine of ammunition. It should be noted that grip 110 can be designed to a grip similar to a particular model of firearm. FCU housing 128, in some embodiments, is configured to FCU or FCU module 108. In an alternative embodiment, grip module 102 is configured to accept any one or more of the upper components of the original firearm (such as the barrel, barrel block, bolt, strike, and/or slide) in addition to FCU module 108. For the forgoing discussion, the terms "FCU" and "FCU module" are referring to the similar component(s) and they can be used interchangeably.

Rear stabilizing connector 112, in some embodiments, is configured to accommodate an arm brace, buttstock, or cheek rest attachment. For example, grip module 102 can be designed as a Short Barrel Rifle ("SBR"), which would convert a pistol or rifle to an SBR or act as an alternative grip module for an existing SBR. In one aspect, the rear attachment, such as an arm brace, cheek rest, or buttstock, is configured to be optionally added or removed from rear stabilizing connector 112. In another aspect, the rear attachment such as buttstock could be designed to be stationary or collapsing, and could also be designed to incorporate a spare magazine holster. A function of the rear attachment such as an arm brace or buttstock is to provide stability of the modified assembly during a firing operation.

Upper receiver 106, in some embodiments, is configured to take the form of an upper receiver with the option of a mounting point, a dust cover, which could use the upper components from the original firearm or new components, a trunnion, or a stationary rail. For example, upper receiver 106 contains scope latches 116-118 which will be used to secure a scope for aiming. Upper receiver 106, in one example, includes an opening for the movement of a bolt and bolt carrier associated with firearm cocking as indicated by numeral 120. Upper receiver 106 further includes a serial displaying window which will be used to show the original serial number of FCU when FCU is inserted into FCU housing 128.

An advantage of employing grip module is that it provides accessory options, capability enhancements, customization options, and other options not available on the otherwise available firearms.

Figure 2A:
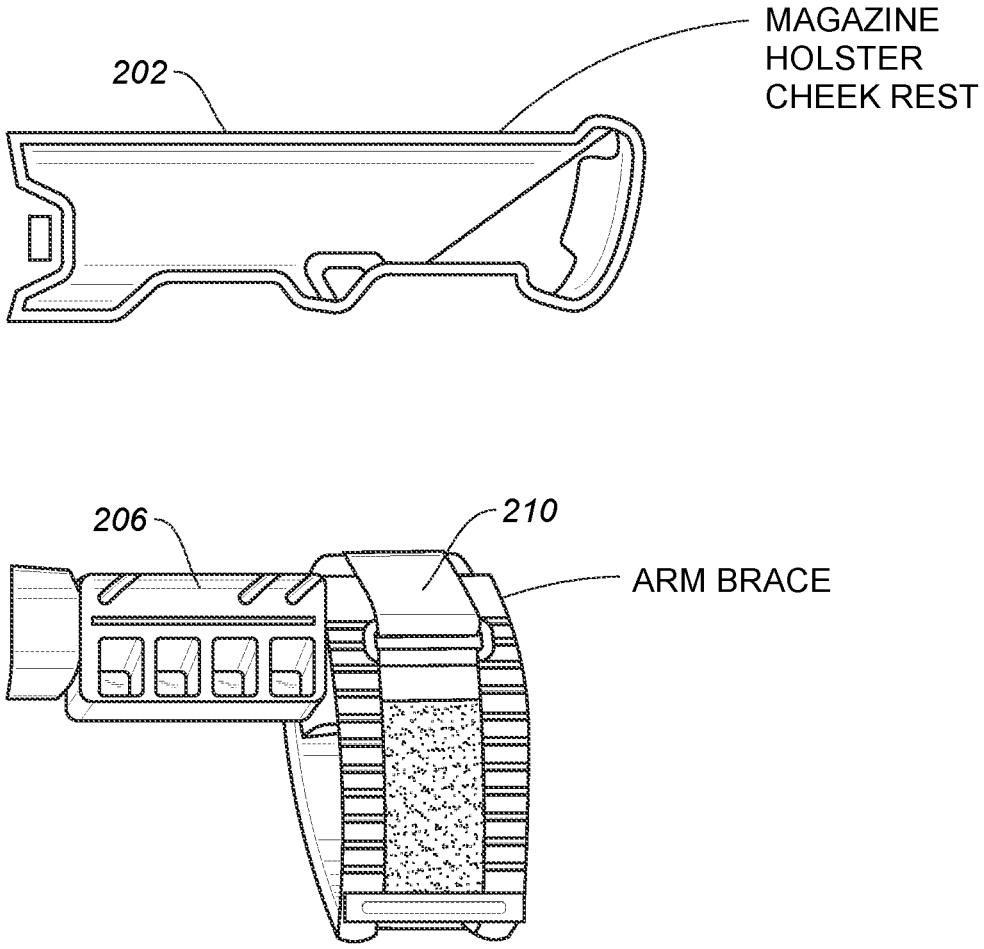
FIGS. 2A-B are diagrams illustrating rear attachments to the grip module in accordance with one embodiment of the present invention.

FIG. 2A illustrates an arm brace 206 and a magazine holster cheek rest 202 capable of being attached to the rear stabilizing connector in accordance with one embodiment of the present invention. Arm brace 206, in one example, can be connected to the rear stabilizing connector of the grip module for providing stability. A strip 210 which can be part of arm brace 206 is used to provide additional stability support. Cheek rest 202, in some embodiments, can be a magazine holster for carrying additional ammunition. Alternatively, cheek rest 202 can be a solid piece for cheek resting. It should be noted that the underlying concept of the exemplary embodiment(s) of the present invention would not change if one or more components (or elements) were added to or removed from diagrams 202 or 206.

Figure 2B:
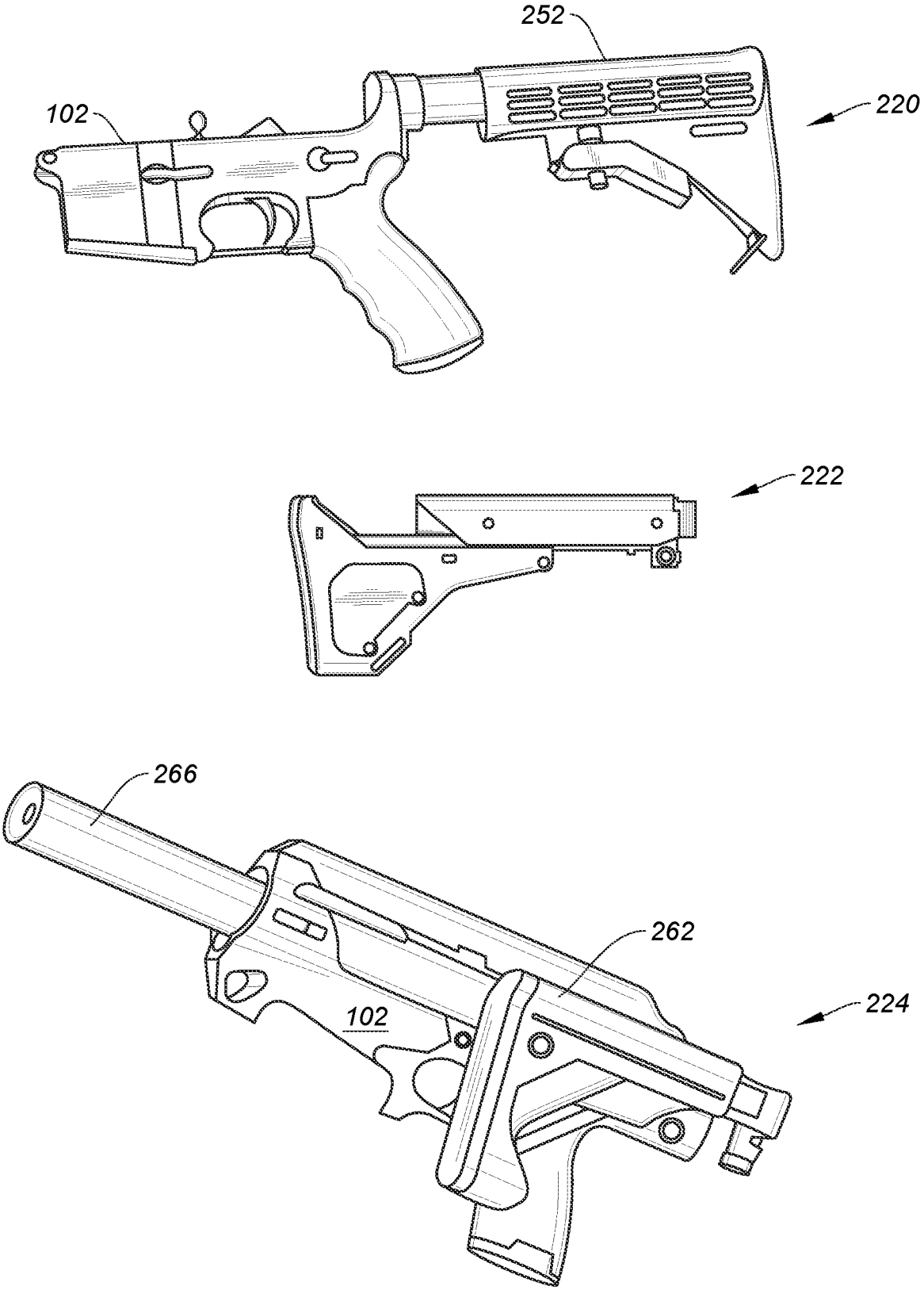

FIG. 2B illustrates diagrams 220-224 showing rear attachments capable of being attached to the grip module in accordance with one embodiment of the present invention. Diagram 220 illustrates a buttstock 252 attached to grip module 102 or lower receiver. In one aspect, buttstock 252 is removable but it is stationary when it is connected. Diagram 222 shows an alternative type of buttstock which can be similar to buttstock 252. Diagram 224 illustrates a modified assembly containing barrel 266, grip module 102, and buttstock 262. In one aspect, buttstock 262 is collapsible by holding buttstock 262 in 180 degrees. It should be noted that the underlying concept of the exemplary embodiment(s) of the present invention would not change if one or more components (or elements) were added to or removed from diagrams 220-224.

Figure 3:
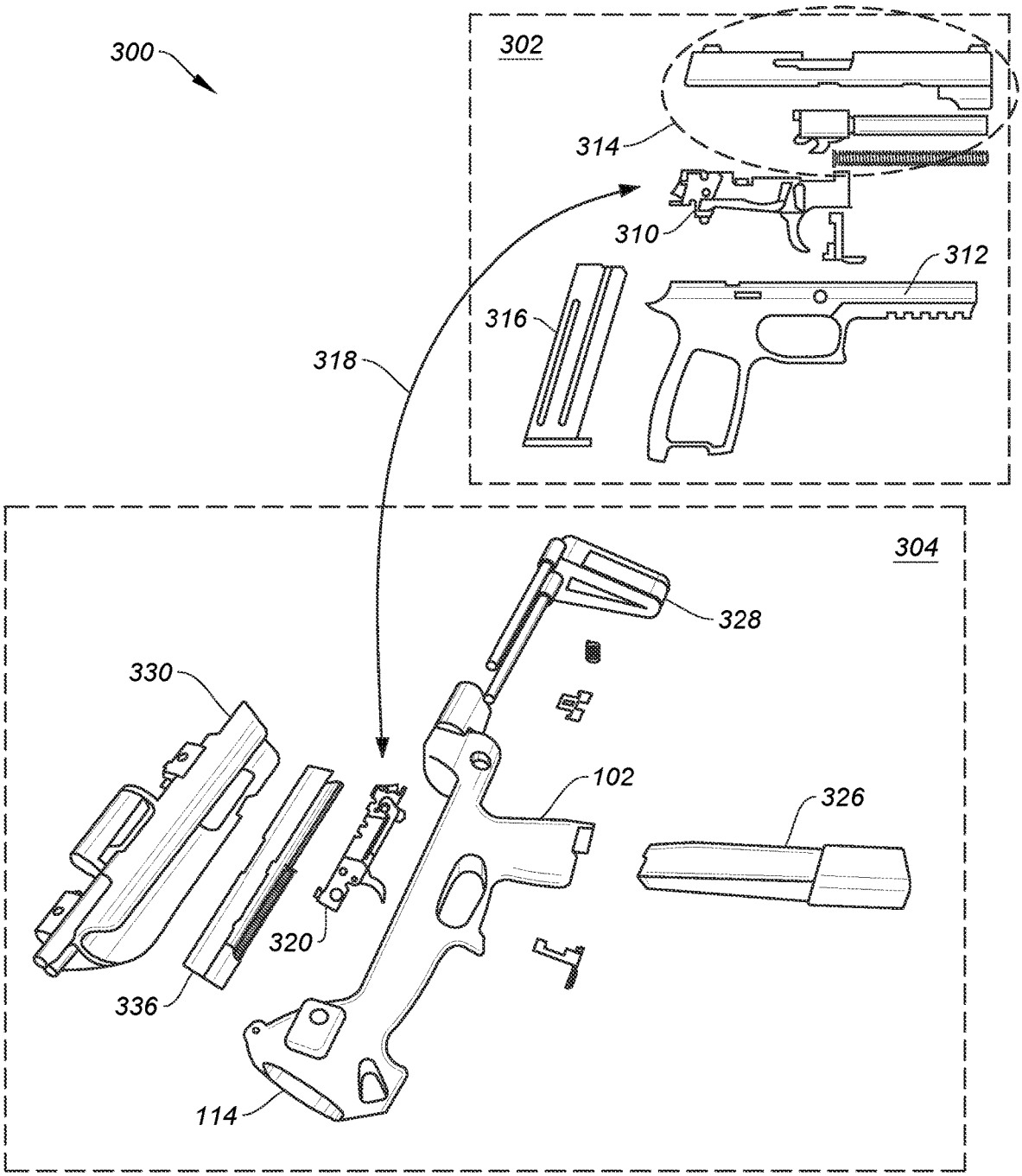
FIG. 3 is a diagram illustrating a conversion process using the same FCU with different bodies in accordance with one embodiment of the present invention.

FIG. 3 is a diagram 300 illustrating a conversion process using the same FCU with different bodies in accordance with one embodiment of the present invention. Diagram 300 includes a pistol 302 and a modified assembly 304 which is configured to resemble as an MP9 (maschinenpistol 9 mm) like submachine gun. In some embodiments, modified assembly 304 is configured to incorporate usage of FCU 320 which is the same or substantially the same as FCU 310 used in pistol 302. It should be noted that the underlying concept of the exemplary embodiment(s) of the present invention would not change if one or more components (or elements) were added to or removed from diagram 300.

Pistol 302, in some embodiments, includes FCU 310, pistol receiver 312, magazine 316, and internal components 314 which includes a slide, barrel, and return spring. Pistol 302, in one example, can be the Glock model 17 which can be easily disassembled to separate FCU 310 from pistol 302. FCU 310, in one embodiment, can be refitted into modified assembly 304 as indicated by numeral 318.

Modified assembly 304, in one embodiment, includes a grip module 102, magazine 326, internal components 336, upper receiver 330, and FCU 320 which is similar or the same as FCU 310. Internal components 336 includes, but not limited to, a slide, a barrel, a barrel block, a bolt, and/or return spring. Grip module includes a rear stabilizing connector which is used to couple to a buttstock 328. It should be noted that when modified assembly 304 is assembled with FCU 320, the assembly should resemble a semiautomatic machine gun such as MP9.

An advantage of using a grip module is that it facilitates a conversion from a pistol like firearm to a rifle or machine gun like firearm using similar FCU modules.

Figure 4:
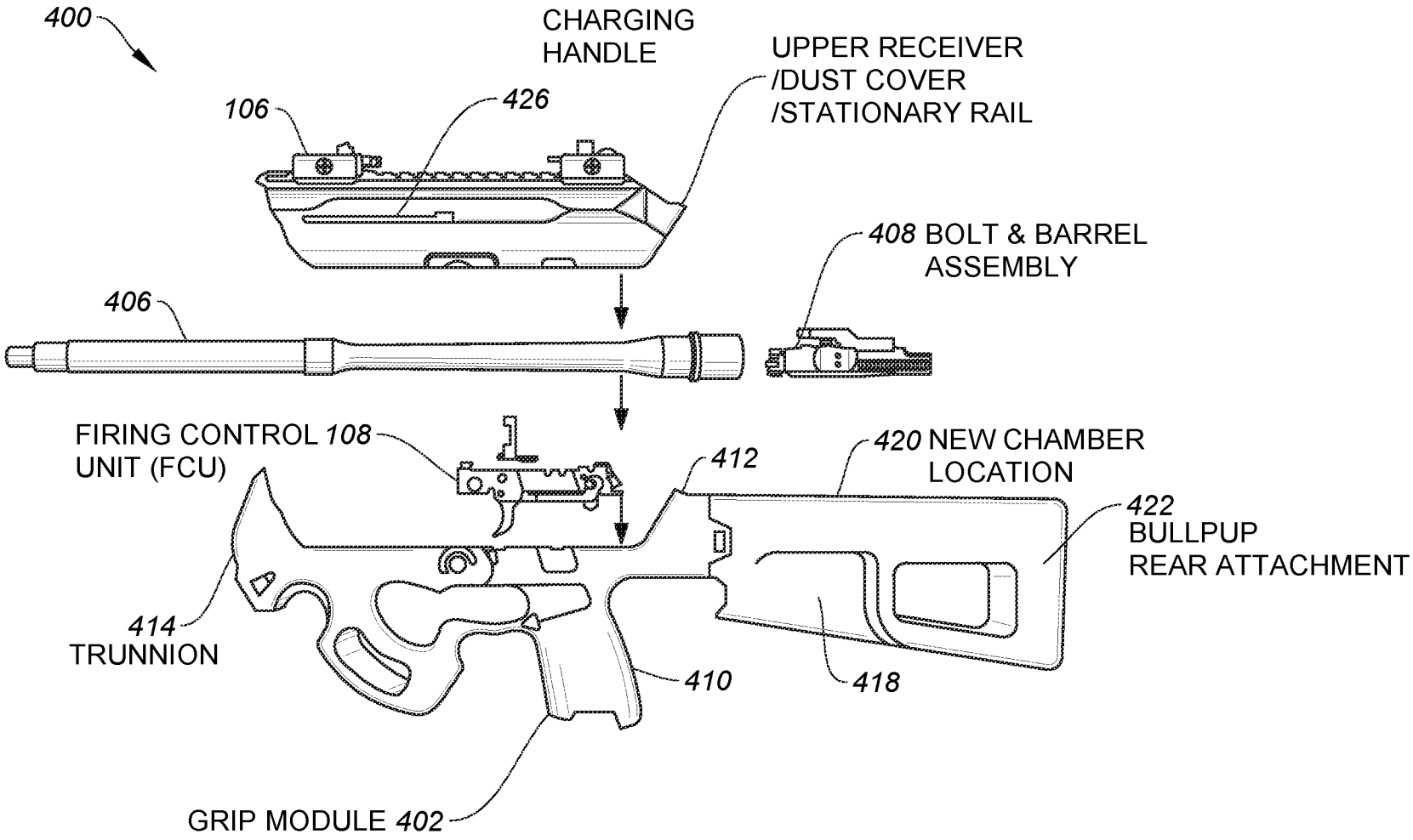
FIG. 4 is a diagram illustrating a bullpup-shaped rifle ("BSR") using the grip module in accordance with one embodiment of the present invention.

FIG. 4 is a diagram 400 illustrating a bullpup-shaped rifle ("BSR") using the grip module in accordance with one embodiment of the present invention. Diagram 400 includes a grip module 402, FCU 108, upper receiver 106, bolt and barrel assembly 408, and barrel 406. Grip module 402, in some embodiments, includes a BSR buttstock 422. It should be noted that the underlying concept of the exemplary embodiment(s) of the present invention would not change if one or more components (or elements) were added to or removed from diagram 400.

Grip module 402, in one aspect, includes a grip or handle 410, FCU housing or cavity for housing FCU 108, trunnion 414, and rear stabilizing connector 412. Grip module 402, in some embodiments, is structured to include at least a portion of lower receiver for a pistol, Small Barrel Rifle ("SBR"), and/or self-loading semiautomatic rifle. It should be noted that the grip module such as grip module 402 is designed to accept an FCU module such as FCU 108 in such a way that the ammunition loading port(s) and/or ammunition type(s) can be deviated from the originally designated port(s) associated with the FCU when it is manufactured.

An SBR, or short barrel rifle is a type of rifle with relatively short barrel(s). For example, an SBR may have a barrel shorter than 16" or smaller than 26" overall length of SBR. Another type of firearm that is similar to SBR is bullpup rifle or Short Barrel Shotgun both of which have relatively short barrels.

The BSR, in one aspect, includes an FCU 108, grip module 402, bullpup rear attachment 422, and bolt and barrel assembly 408, and is capable of firing an object such as a bullet. FCU 108 is configured to be a serialized trigger mechanism capable of initiating launching a directional object when a trigger is pulled. Grip module 402 further contains a grip 410, FCU housing, and rear stabilizing connector 412, wherein the FCU housing is configured to house a removable FCU such as FCU 108.

Bullpup rear attachment 422, coupled to the rear stabilizing connector, is used to enhance overall stability of the BSR. In one example, bullpup rear attachment 422 is configured to have a magazine port 418 for receiving a magazine. The magazine, in one example, is a vessel or receptacle for housing ammunition. Bolt and barrel assembly 408 is situated above magazine port 418 inside attachment 422 for facilitating firing of the object. In one example, bolt and barrel assembly 408 is physically situated behind FCU 108.

The BSR further includes an upper receiver configured to couple to grip module 402 capable of enclosing FCU 108 as well as assembly 408 between upper receiver 106 and grip module 402. Upper receiver 106 includes scope latches 106 capable of receiving a scope for target aiming and a charging handle 426. FCU 108 contains an original serial number for identifying FCU and/or firearm. Grip module 402 contains a serial number window which is located in such a way that when FCU 108 is inserted in the FCU housing of grip module 402, the original serial number of FCU 108 displays through the serial number window. Grip module 402, in some embodiments, can be fabricated by one of aluminum, zinc, alloy, composite materials, and pressure resistance plastics. Grip module 402 includes a trunnion 414, barrel block, or receiver which are used to receive or attach a barrel 406 coupling to grip module 402.

An advantage of using grip module 402 is that it enable to a user to convert from a pistol to a semiautomatic machine gun or rifle or vice versa.

Figure 5:
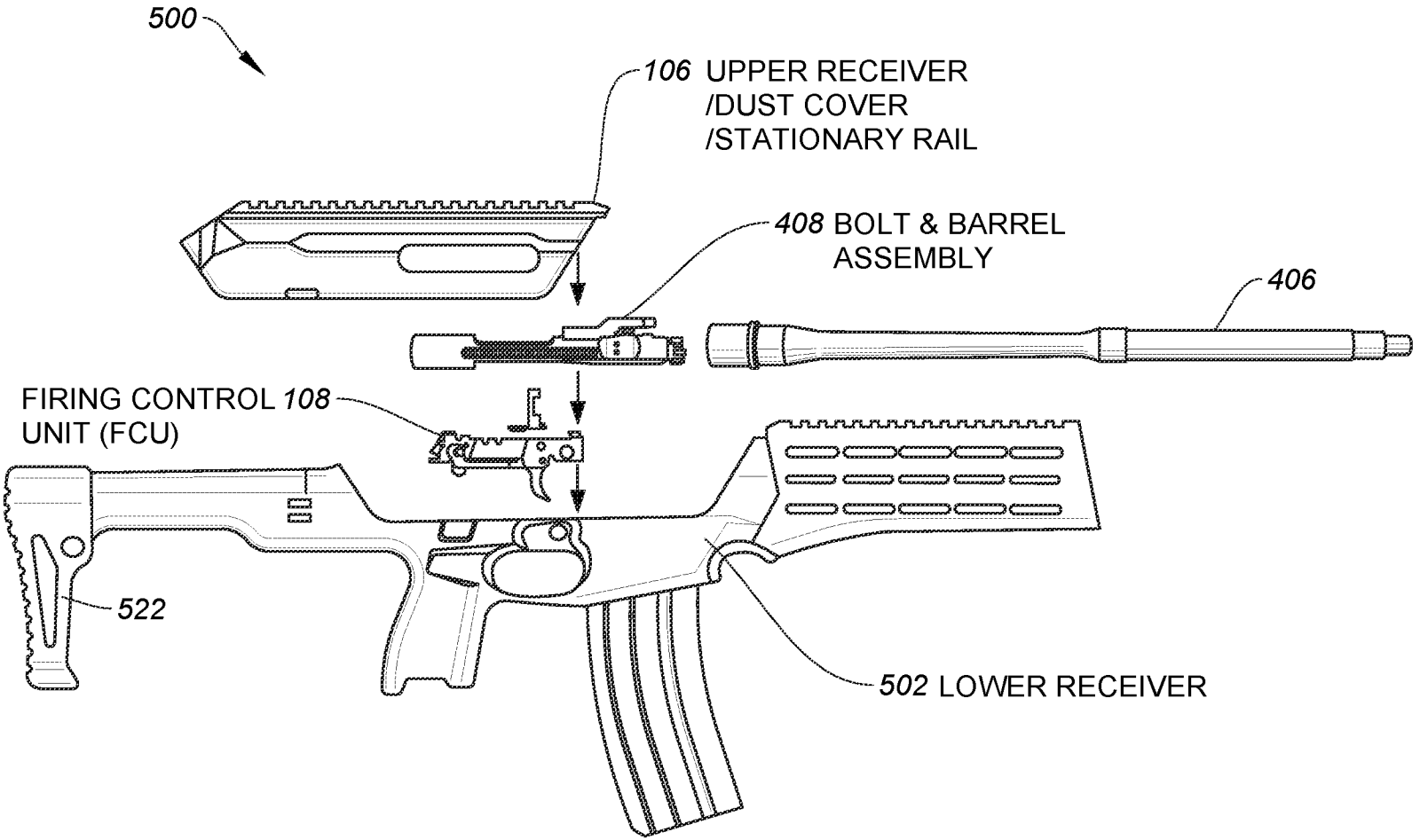
FIG. 5 is a diagram illustrating a carbine-like rifle using the grip module in accordance with one embodiment of the present invention.

FIG. 5 is a diagram 500 illustrating a carbine-like rifle using a grip module in accordance with one embodiment of the present invention. Diagram 500 includes grip module 502 and buttstock 522. In one aspect, bolt and barrel assembly 408 is situated in the vicinity of FCU 108. A carbine rifle is a relatively long gun with a medium range barrel which is generally shorter than a rifle. A carbine rifle, such as M4 carbine, is a version of rifle capable of firing rifle ammunition as well as pistol ammunition. It should be noted that the underlying concept of the exemplary embodiment(s) of the present invention would not change if one or more components (or elements) were added to or removed from diagram 500

In operation, grip module or lower receiver 502 is configured to house FCU 108 as well as bolt and barrel assembly 408. Barrel 406 can be coupled to bolt & barrel assembly 406 using either a bolt block, lower receiver, and/or assembly 408. Upper receiver, which can perform a function of dusk cover and/or stationary rail, is coupled to lower receiver 502. A benefit of using the embodiment of grip module or lower receiver 502 is that it facilitates converting a hand gun to a carbine-like rifle using some components of the hand gun such as FCU.

Figure 6:
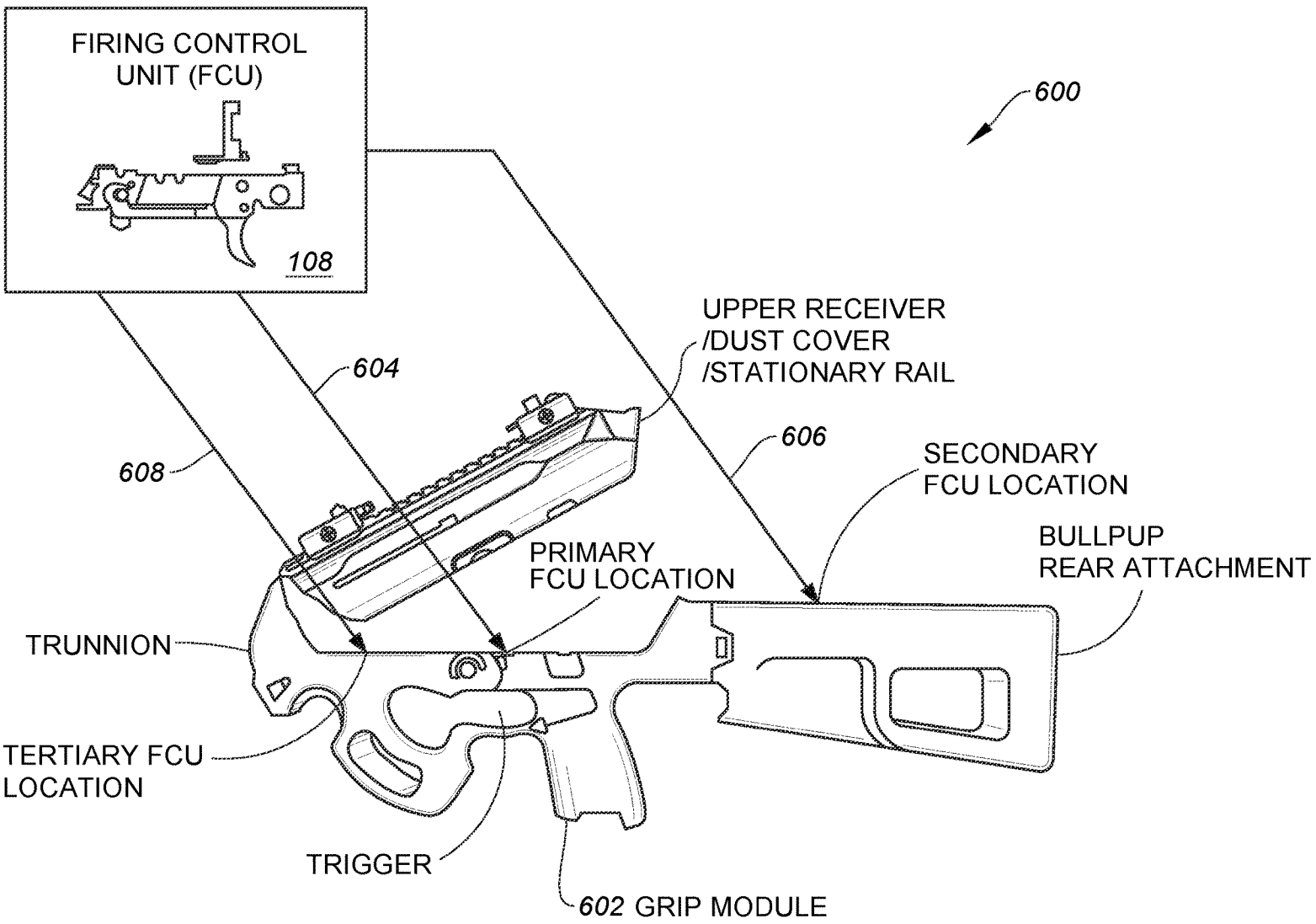
FIG. 6 is a diagram illustrating a grip module capable of housing multiple FCUs in accordance with one embodiment of the present invention.

FIG. 6 is a diagram 600 illustrating a grip module capable of housing one or more FCUs in accordance with one embodiment of the present invention. Diagram 600 illustrates a semiautomatic firearm assembly able to expel ammunition. The firearm assembly includes FCU 108, grip module 602, upper receiver, and bullpup rear attachment. FCU 108, in some embodiments, controls firing sequence. Grip module 602 contains a grip, first FCU housing or primary FCU location referenced by numeral 604, second FCU housing or secondary FCU location referenced by numeral 606, third FCU housing or tertiary FCU location referenced by numeral 608, and rear stabilizing connector. The rear stabilizing connector is used to couple to a bullpup rear attachment or buttstock.

First FCU housing or primary FCU location is situated above the trigger, and second FCU housing or secondary FCU location is situated in behind of the trigger. It should be noted that barrel of a gun is referred as the front of gun and buttstock is referred to as the back of the gun. Also, the direct against the gravity is referred to as up or above and the direct with the gravity is referred to as low or below. Third FCU housing or tertiary FCU location is situated in the front of the trigger, wherein the first, second, and third FCU housings are capable of housing one or more FCU modules which can be used to facilitate launching one or more types of ammunition substantially the same time.

In some embodiments, the primary FCU location or primary FCU module location is configured to be above the trigger, and the secondary FCU location or FCU module location is situated to be forward of the trigger. The tertiary FCU module location or FCU location is rearward of the trigger as indicated by numeral 608. In some aspects, grip module 602 is designed to accept an FCU module at any two of the primary, secondary, and tertiary FCU module locations. Grip module 602, in one embodiment, utilizes a single external trigger to actuate one or more FCUs situated in the FCU module locations referenced by numbers 604-608. Grip module 602, in an alternative embodiment, utilizes a single external trigger to actuate three FCUs situated in the FCU module locations referenced by numbers 604-608.

Alternatively, different FCU can be configured to control firing different caliber of bullets. For example, the first FCU may be used to fire 50 caliber ("50 cal") while the second FCU may be used to control filing of 5.56 millimeters ("mm"). It should be noted that Caliber (Cal) is the diameter of a firearm's bore. For example, "50 cal" is a 0.50 inch caliber, or a half-inch in diameter. Also, 9 mm, 5.56 mm, 7.62 mm are usually referring to the diameter of the bore and bullet that goes through it.

An advantage of using more than one FCU modules or using one FCU module control multiple types of ammunition is to allow a user to launch a grenade, missile, and/or drone while keeping firing of bullets.

Figure 7:
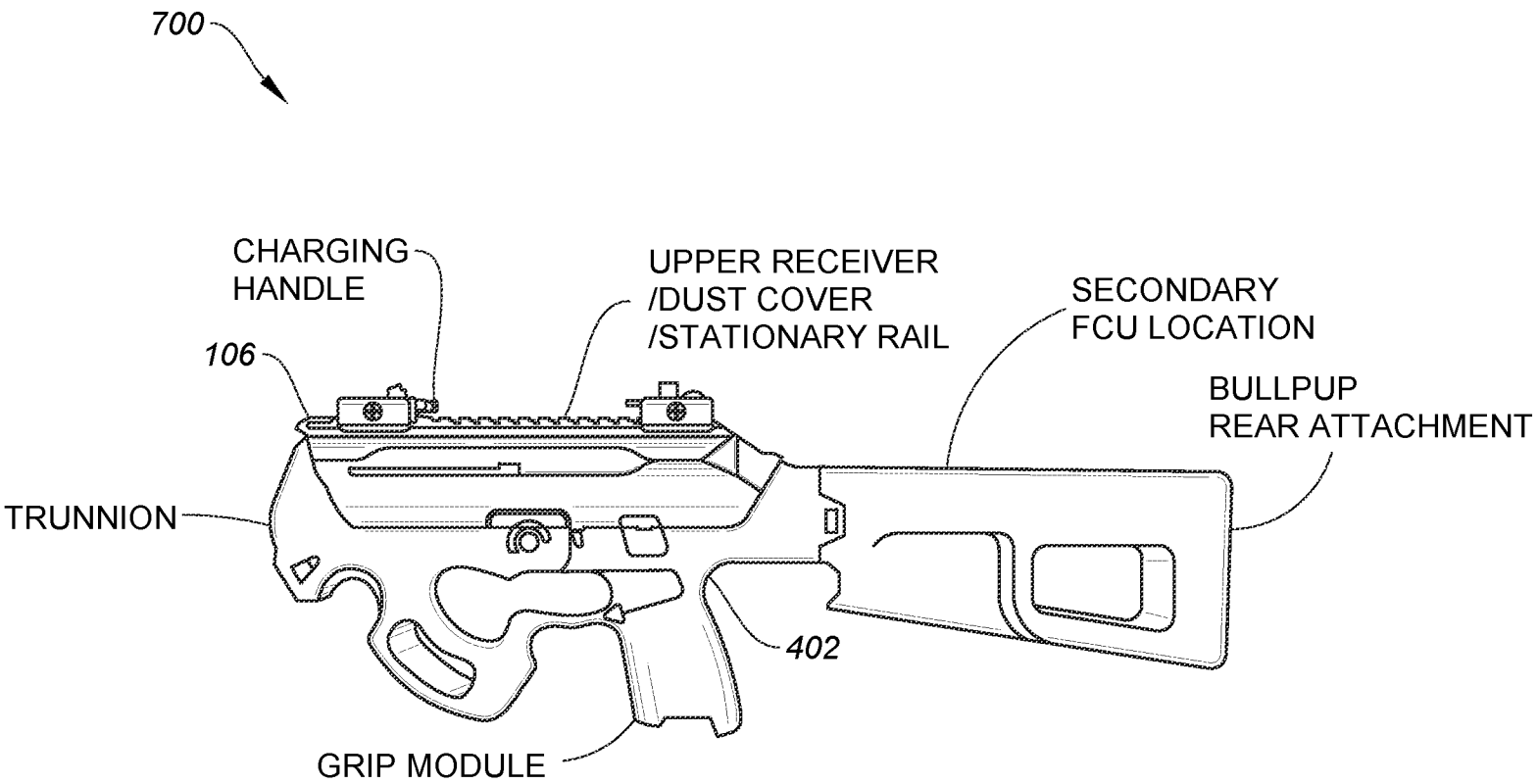
FIG. 7 is a diagram illustrating a modified assembly having a grip module and upper receiver in accordance with one embodiment of the present invention.

FIG. 7 is a diagram 700 illustrating a modified assembly having a grip module and upper receiver in accordance with one embodiment of the present invention. Diagram 700, in one embodiment, is similar to diagram 600 except that the upper receiver and lower receiver (or grip module 402) are in closed formation. In one aspect, the modified assembly can be used to convert a pistol to a bullpup-like rifle using some of the pistol's components such as the FCU or vice versa.

Figure 8:
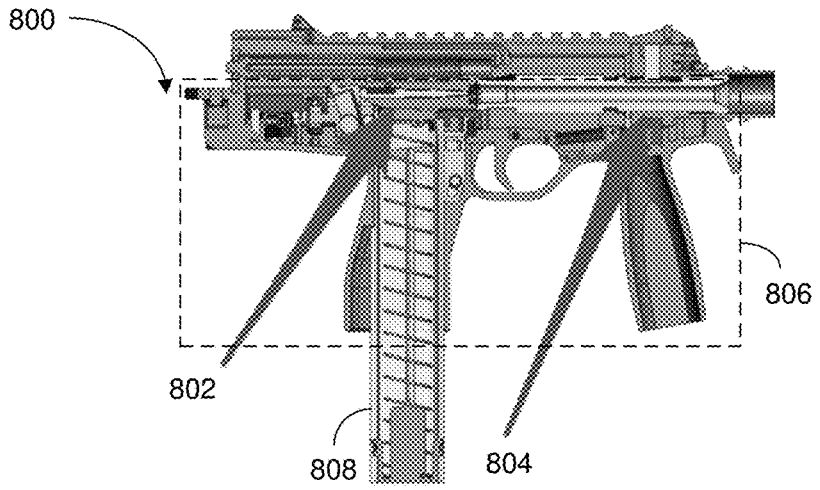
FIG. 8 is a diagram illustrating cut-open illustrations of guns showing internal components in accordance with one embodiment of the present invention.
Figure 8:
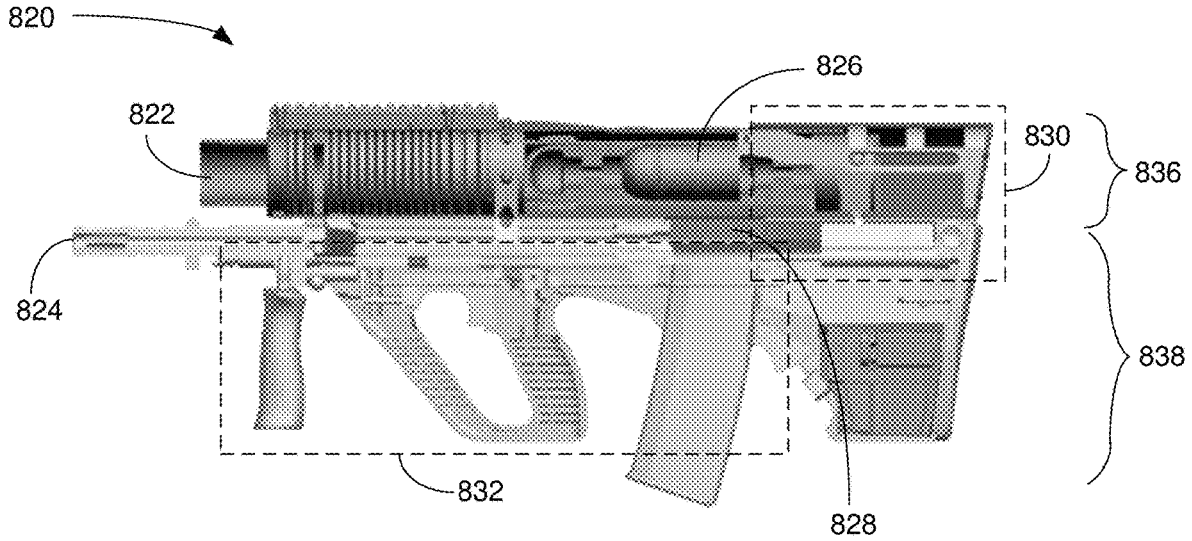

FIG. 8 is a diagram illustrating cut-open illustrations of an MP9 like gun 800 and bullpup rifle with grenade launcher (or semiautomatic machine gun) 820 showing internal components in accordance with one embodiment of the present invention. MP9 like gun 800 illustrates a bolt 802 and a barrel block 804 wherein barrel block 804 is used to anchor a barrel, not shown in FIG. 8. In some embodiments, the grip module such as grip module 806 is designed to accept variable sized barrels for different sized ammunition. Grip module 806 containing a grip is capable of receiving a magazine 808 to facilitate burst firing of bullets.

Machine gun 820 includes a gun portion 838 and a grenade launcher 836 wherein gun portion 838 includes a grip module 832, barrel 824, and bullet(s) 828. Grenade launcher 826 includes grenade(s) 826 and launcher barrel 822. In some aspects, FCU(s) 830 can be in gun portion 838, launcher 836, or both depending on the configuration of FCU(s). For example, gun 820 includes a bullpup rifle portion 838 containing barrel 824 and grenade launcher 838 with a barrel 822. It should be noted that grenade launcher 838 can launch grenades, drones, missiles, and/or cannons.

Grip module 832, in one example, is designed to accept barrels 822-824 for various sized ammunition such as grenade 826 and bullet 828. In one embodiment, grip module 832 accepts a barrel at the Primary, Secondary, or Tertiary FCU module location as well as two or three barrels simultaneously. Alternatively, grip module 806 or 832 is designed to convert the slide or bolt carrier of the original firearm into a bolt carrier or slide. Grip module 832 or 806 is designed to use the FCU module as a triggering device that activates a firing apparatus. It should be noted that grip module such as grip module 832 is capable of permitting the FCU module such as FCU 830 to activate one or more types of ammunition substantially concurrent.

An advantage of using the grip module is to increase the versatility of firearm using a portion of existing components such as FCU(s).

In some embodiments, gun 820 includes a semiautomatic firearm assembly able to expel or fire bullets and/or grenades. Gun 820 includes an FCU module 830 and grip module 832. FCU module 830 is configured to be a serialized trigger mechanism capable of initiating launching one or more directional objects such as bullets and grenade when a trigger is pulled. FCU module 830, in one embodiment, includes a single FCU configured to control both bullet and grenade firings. Alternatively, FCU module 830 includes two FCUs wherein one FCU is used to fire bullets 828 while another FCU is used to launch grenades 826. It should be noted that additional FCUs may be used to control additional types of ammunition.

Gun 820 further includes an upper receiver configured to couple to the grip module such as grip module 832 for enclosing the FCU, bolt and barrel assembly between the upper receiver and the grip module. Note that the FCU situated in the grip module is able to select one of multiple types of ammunition. In some embodiments, the FCU situated in the first FCU housing is actuated via a triggering system for firing a bullet while the FCU situated in the second FCU housing is actuated via the triggering system for launching a grenade.

Figure 9:
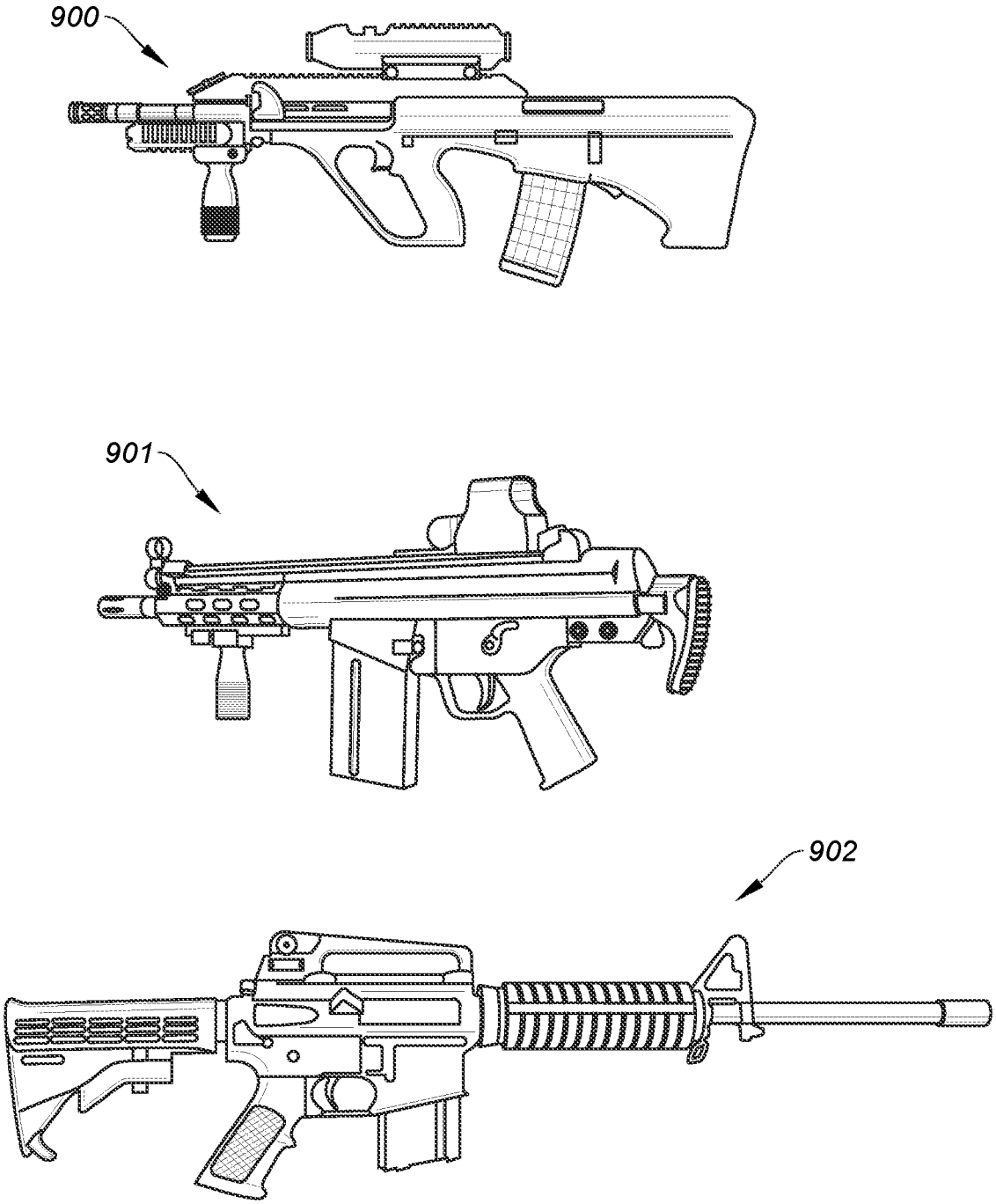
FIGS. 9-10 are diagrams illustrating exemplary firearms capable of using grip modules in accordance with one embodiment of the present invention.
Figure 10:
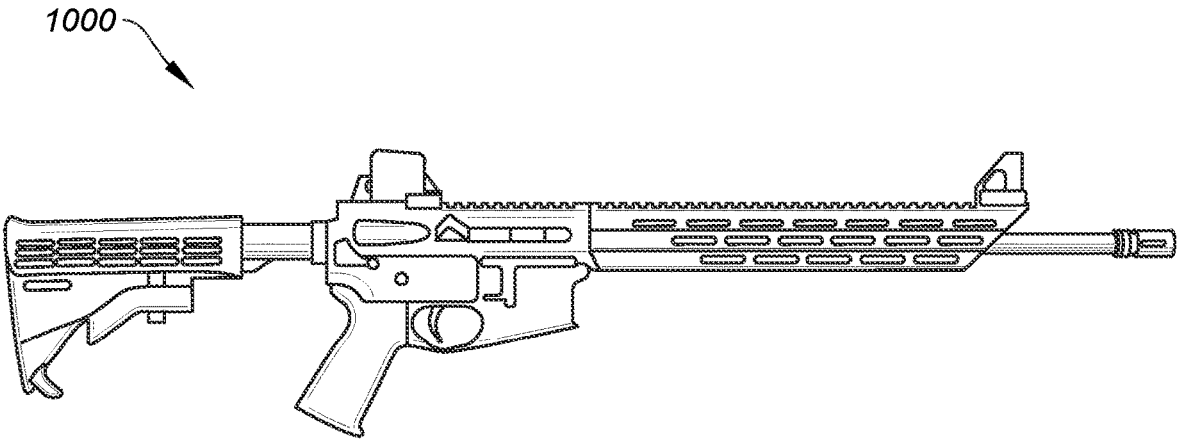
Figure 10:
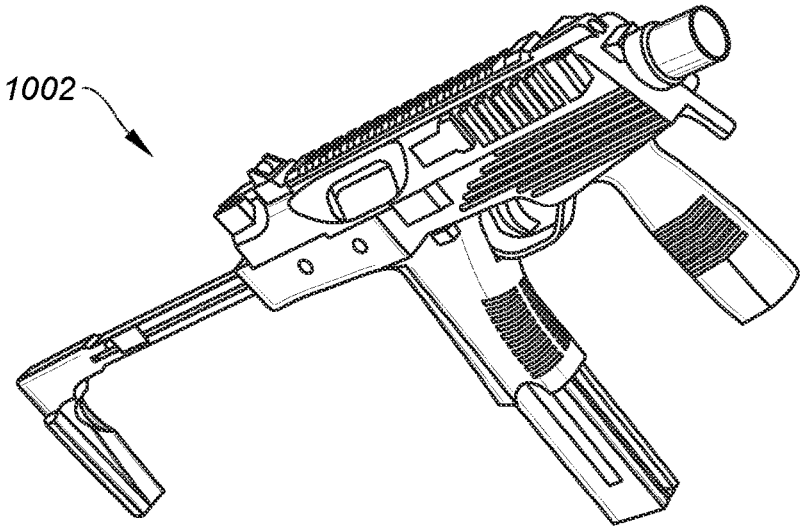

FIGS. 9-10 are diagrams 900-1002 illustrating exemplary firearms capable of using grip modules in accordance with one embodiment of the present invention. It should be noted that the illustrated firearms are self-loading rifles or machine guns. Self-loading or automatic loading semiautomatic firearm can be referred to as automatic loading of ammunition in response to the prior firing. It should be noted that the underlying concept of the exemplary embodiment(s) of the present invention would not change if one or more guns (or elements) were added to or removed from diagrams 900-1002.

Diagram 900 illustrates a bullpup or bullpup like rifle capable of firing ammunition continuously using self-loading mechanism. Embodiments of grip module can be employed to convert between a hand gun and a bullpup like rifle using certain shared components such as FCU module(s). A benefit of using the embodiment(s) of the grip module is to enable a user to interchange certain components such FCU module(s) between pistols, rifles, and machine guns.

According to diagram 900, a firearm assembly includes an existing FCU and a kit which has a shape resembling a bullpup rifle. To assemble the firearm assembly resembling a bullpup rifle, a removable FCU from a handgun is required. It should be noted that a firearm kit generally contains most of the necessary firearm components needed to assemble a bullpup-rifle-like weapon except an FCU. An advantage of using the bullpup-rifle-like firearm kit is that the kit allows a user to modify a handgun into a bullpup-rifle-like firearm.

A handgun is defined as a firearm which is also known as a revolver or pistol configured to be held and fired with one hand. A handgun or pistol generally has a dimension that is overall length of less than 26 inches or a barrel or barrels of less than 16 inches in length. An exemplary handgun containing FCU can be, but not limited to, Sig Sauer p250™, Sig Sauer p320™, Sig Sauer M17™, Sig Sauer M18™, Sig Sauer X5 Legion™, Beretta APX™, Ruger 57™, Ruger all American™, Sig Sauer p365™, Sig Sauer p365x1™, Steyr A1™, Steyr A2™, and the like.

Diagram 901 illustrate a small barrel rifle ("SBR") or SBR like rifle capable of firing ammunition continuously using self-loading mechanism. Embodiments of grip module can be employed to convert between a hand gun and a SBR like rifle using certain shared components such as FCU module(s). A benefit of using the embodiment(s) of the grip module is to enable a user to interchange certain components such FCU module(s) between pistols, rifles, and machine guns.

In one example, SBR like rifle includes a firearm kit and an existing FCU disassembled from a handgun. To assemble a firearm resembling SBR, a removable FCU from a handgun is required. In one aspect, a firearm kit includes most of the components needed to assemble a SBR like rifle except an FCU. An advantage of using an SBR like firearm kit is that the kit allows a user to modify a handgun into an SBR like firearm.

Diagram 902 illustrate an AR such as AR 15 like rifle capable of firing ammunition continuously using self-loading mechanism. Embodiments of grip module can be employed to convert between a hand gun and an AR 15 like rifle using certain shared components such as FCU module(s). A benefit of using the embodiment(s) of the grip module is to enable a user to interchange certain components such FCU module(s) between pistols, rifles, and machine guns.

To assemble a firearm resembling AR 15, a removable FCU from a handgun is required. For example, a firearm kit includes most of the components needed to assemble an AR 15-like firearm except an FCU. An advantage of using AR 15-like firearm kit is that the kit allows a user to modify a handgun into an AR 15-like firearm.

Diagram 1000 illustrate a carbine rifle or carbine like rifle capable of firing ammunition continuously using self-loading mechanism. Embodiments of grip module can be employed to convert between a hand gun and a carbine like rifle using certain shared components such as FCU module(s). A benefit of using the embodiment(s) of the grip module is to enable a user to interchange certain components such FCU module(s) between pistols, rifles, and machine guns.

To assemble a firearm resembling carbine rifle, a removable FCU from a handgun is required. For example, a firearm kit includes most of the components needed to assemble a carbine rifle-like firearm except an FCU. An advantage of using carbine rifle-like firearm kit is that the kit allows a user to modify a handgun into a carbine rifle-like firearm.

Diagram 1002 illustrate an MP9 or MP9 like gun capable of firing ammunition continuously using self-loading mechanism. Embodiments of grip module can be employed to convert between a hand gun and an MP9 like rifle using certain shared components such as FCU module(s). A benefit of using the embodiment(s) of the grip module is to enable a user to interchange certain components such FCU module(s) between pistols, rifles, and machine guns.

To assemble a firearm resembling MP7 or MP9, a removable FCU from a handgun is required. For example, a firearm kit includes most of the components needed to assemble an MP9-like firearm except an FCU. An advantage of using an MP9-like firearm kit is that the kit allows a user to modify a handgun into an MP9.

Ammunition in Front of FCU

One embodiment of the presently claimed invention discloses a full or semiautomatic firearm assembly assembled based on a firearm kit and an existing FCU disassembled from a handgun. While the firearm kit is configured to house the existing FCU as its firing mechanism, the kit further includes a grip module and an EFS. The grip module, in one embodiment, includes a handgrip, an FCU housing, a trigger guard, and a magazine port wherein the trigger guard is situated between the handgrip and the magazine port. The magazine port is located in front of the handgrip or trigger away from a user. The EFS uses an extended firing pin ("EFP") to fire bullets or ammunition from a magazine which is inserted in the magazine port when the trigger of FCU is pulled.

Figure 11A:
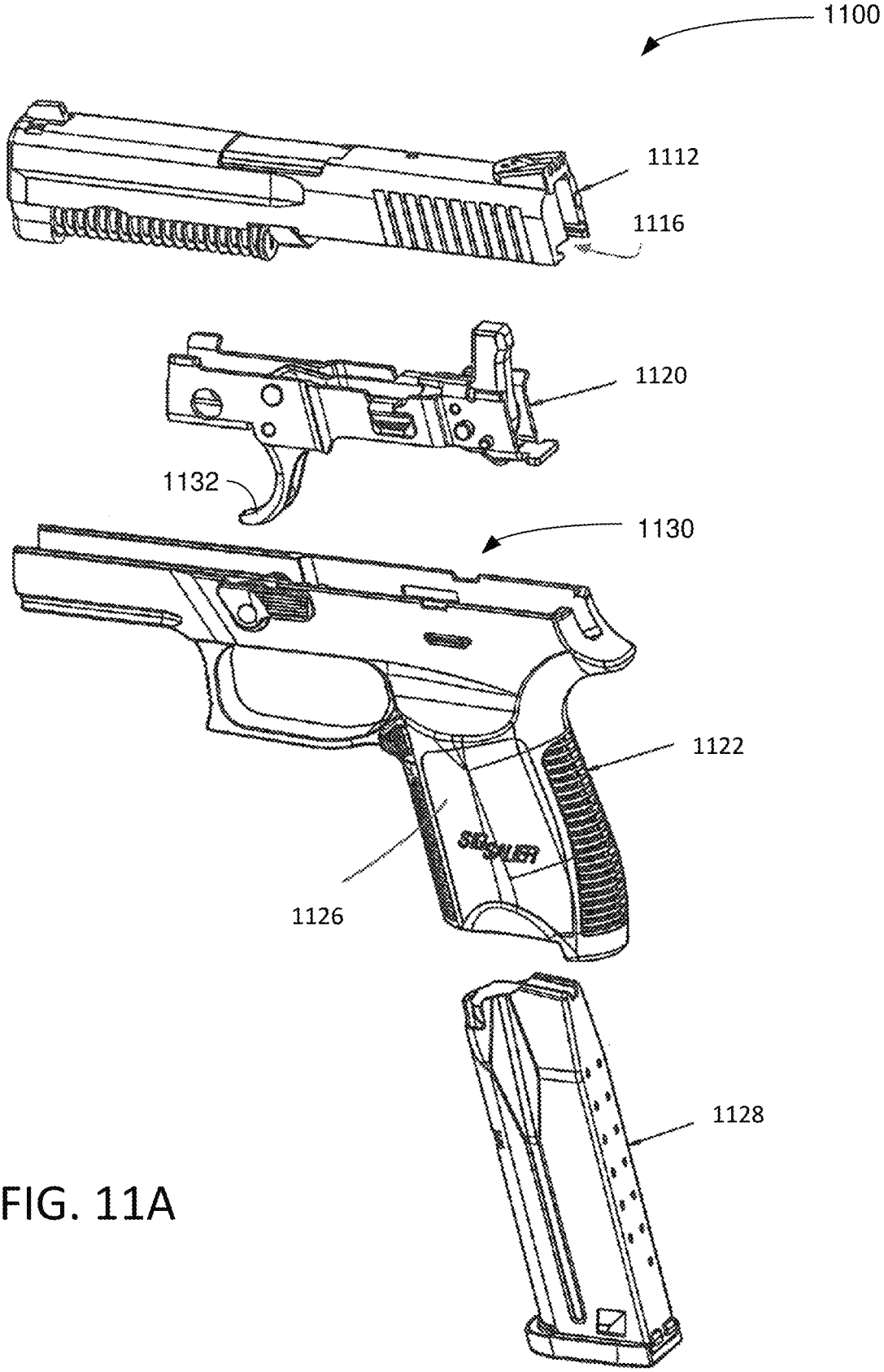
FIGS. 11A-11C are diagrams illustrating an exemplary firearm resembling a carbine rifle like semiautomatic rifle using a firearm kit and an existing FCU disassembled from a handgun in accordance with one embodiment of the present invention.
Figure 11B:
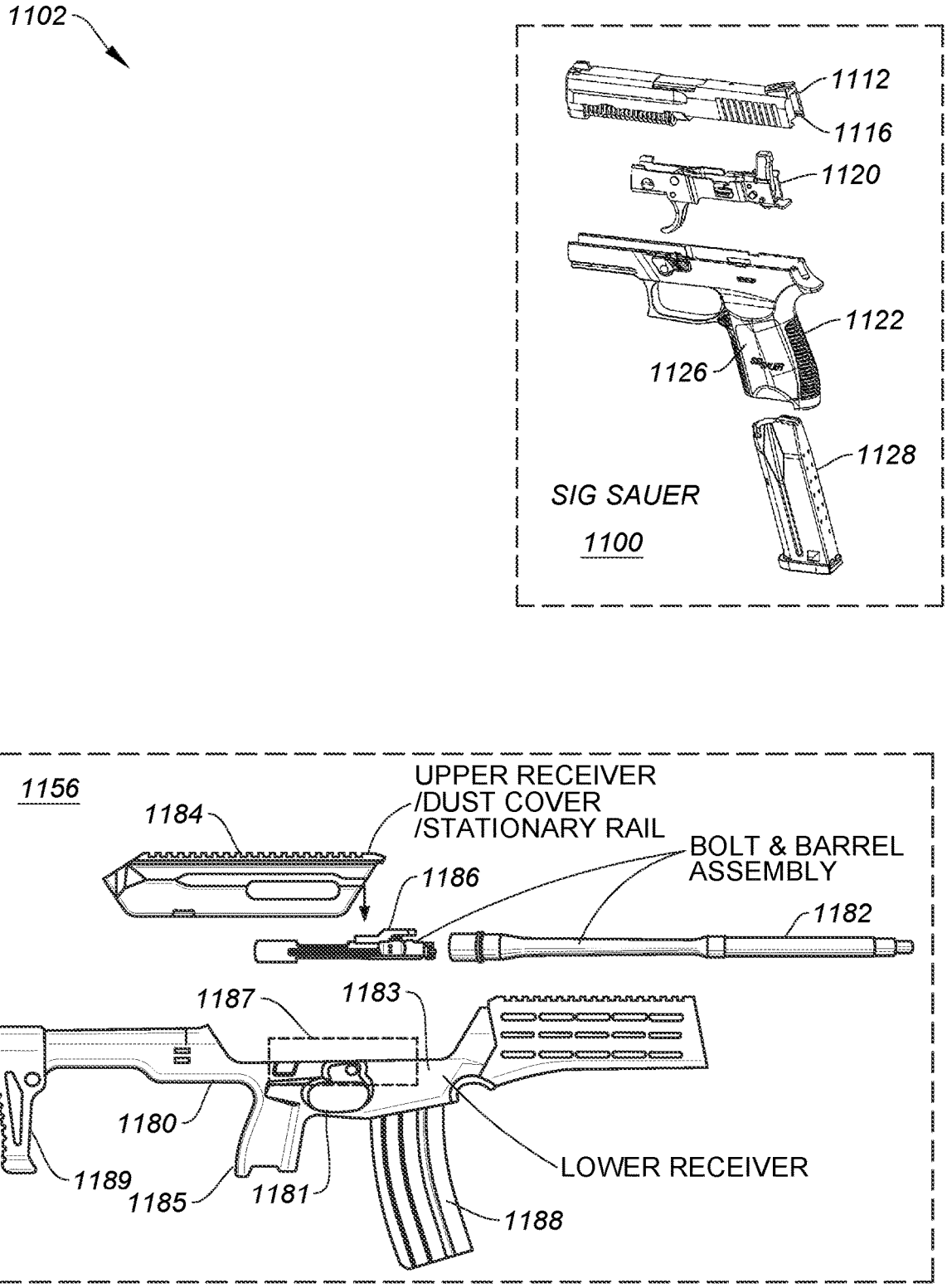
Figure 11C:
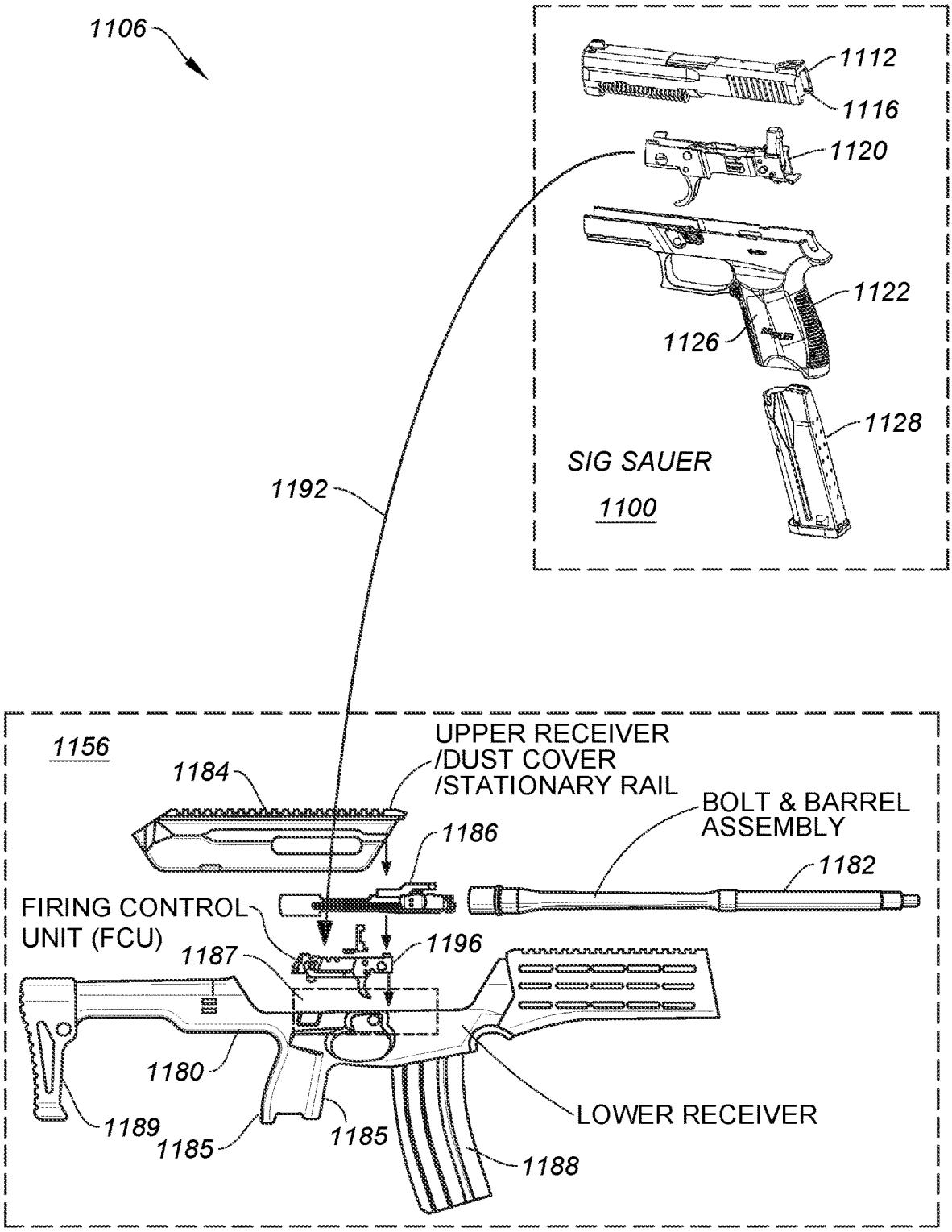

FIGS. 11A-11C are diagrams illustrating an exemplary firearm resembling a carbine rifle like semiautomatic rifle using a firearm kit and an existing FCU disassembled from a handgun in accordance with one embodiment of the present invention. FIG. 11A illustrates a handgun 1100 containing a slide assembly or slide 1112, an FCU 1120, a receiver 1126, and a magazine 1128. Magazine 1128 can be inserted into a handgrip 1122 of receiver 1126. Magazine 1128, for example, can be removably received within an interior compartment defined by a generally hollow handgrip 1122 of receiver 1126. It should be noted that the underlying concept of the exemplary embodiment(s) of the present invention would not change if one or more components (or elements) were added to or removed from FIG. 11A.

Handgun or pistol 1100 is a firearm operated by a single hand. Handgun 1100, for example, can be a SIG SAUER P320™, SIG SAUER P250™, GLOCK 17™, or GLOCK 19™ type of gun. A handgun, such as SIG SAUER P320™, has a dimension of 8" (inch) long, 1.4" width, and 5.5" height and can be hold by one hand before firing. Slide 1112 includes an axial channel 1116 and a barrel (not shown in FIG. 11A) received within channel 1116. A recoil spring (not shown in FIG. 11A) is coaxially received about a recoil spring guide for returning slide 1112 into a state of battery.

FCU 1120, in one aspect, is a unit having a serialized trigger mechanism capable of firing a bullet or ammo when its trigger 1132 is pulled. FCU 1120 is originally designed and fabricated for handgun 1100 as such SIG SAUER P320™. FCU 1120 generally includes a serial number which is used to identify a firearm. In operation, FCU 1120 can be removed or lifted from an interior structure 1130 of receiver 1126.

An advantage of using FCU 1120 of handgun 1100 for modifying a semiautomatic weapon is that FCU 1120 as a whole firing module can be easily removed from handgun 1100.

FIG. 11B illustrates a handgun 1100 and a firearm kit or kit 1156 in accordance with one embodiment of the present invention. Kit 1156, in one embodiment, includes a grip module 1180, an upper receiver 1184, a magazine 1188, a barrel 1182, a buttstock 1189, and a bolt & barrel assembly 1186. Grip module 1180, which is also known as a lower receiver, includes an FCU housing 1187, a magazine port 1183, and a trigger guard 1181. In one embodiment, trigger guard 1181 is situated or placed in front of handgrip 1185 and behind magazine port 1183 away from the user. In one aspect, bolt and barrel assembly 1186 is situated in the vicinity of FCU housing 1187.

In one aspect, kit 1156 is specifically structured in a shape resembling a carbine rifle which is a relatively long gun with a medium range barrel. It should be noted that a carbine rifle, such as M4 carbine, is a version of rifle capable of firing rifle ammunition as well as pistol or handgun ammunition. Kit 1156, in one aspect, includes most of the firearm components except an operational FCU whereby Kit 1156 alone cannot fire any bullets. It should be noted that the underlying concept of the exemplary embodiment(s) of the present invention would not change if one or more components (or elements) were added to or removed from diagram 1102.

In operation, grip module or lower receiver 1180 is configured to house an FCU and a bolt and barrel assembly 1186. Barrel 1182 is coupled to bolt & barrel assembly 1186 using a bolt block. Upper receiver 1184, which can perform a function of dusk cover and/or stationary rail, is coupled to lower receiver 1180.

A benefit of using the embodiment of grip module or lower receiver 1180 is that it facilitates converting a hand gun to a carbine-like rifle using some components of the handgun such as an FCU.

FIG. 11C illustrates a modification of converting an operable handgun 1100 to a carbine-like rifle using a firearm kit 1156 in accordance with one embodiment of the present invention. Handgun 1100, in one example, is a SIG SAUER P320™ containing an FCU 1120. FCU 1120, in one aspect, can be easily disassembled from handgun 1100. FCU 1120 is subsequently refitted into FCU housing 1187 of kit 1156 as indicated by numeral 1192. It should be noted that FCU housing 1187 is specifically designed, configured, and/or structured to receive FCU 1120. Once FCU 1120 is inserted into FCU housing 1187, Kit 1156 is modified into an operational carbine-like rifle or semiautomatic firearm.

Figure 12A:
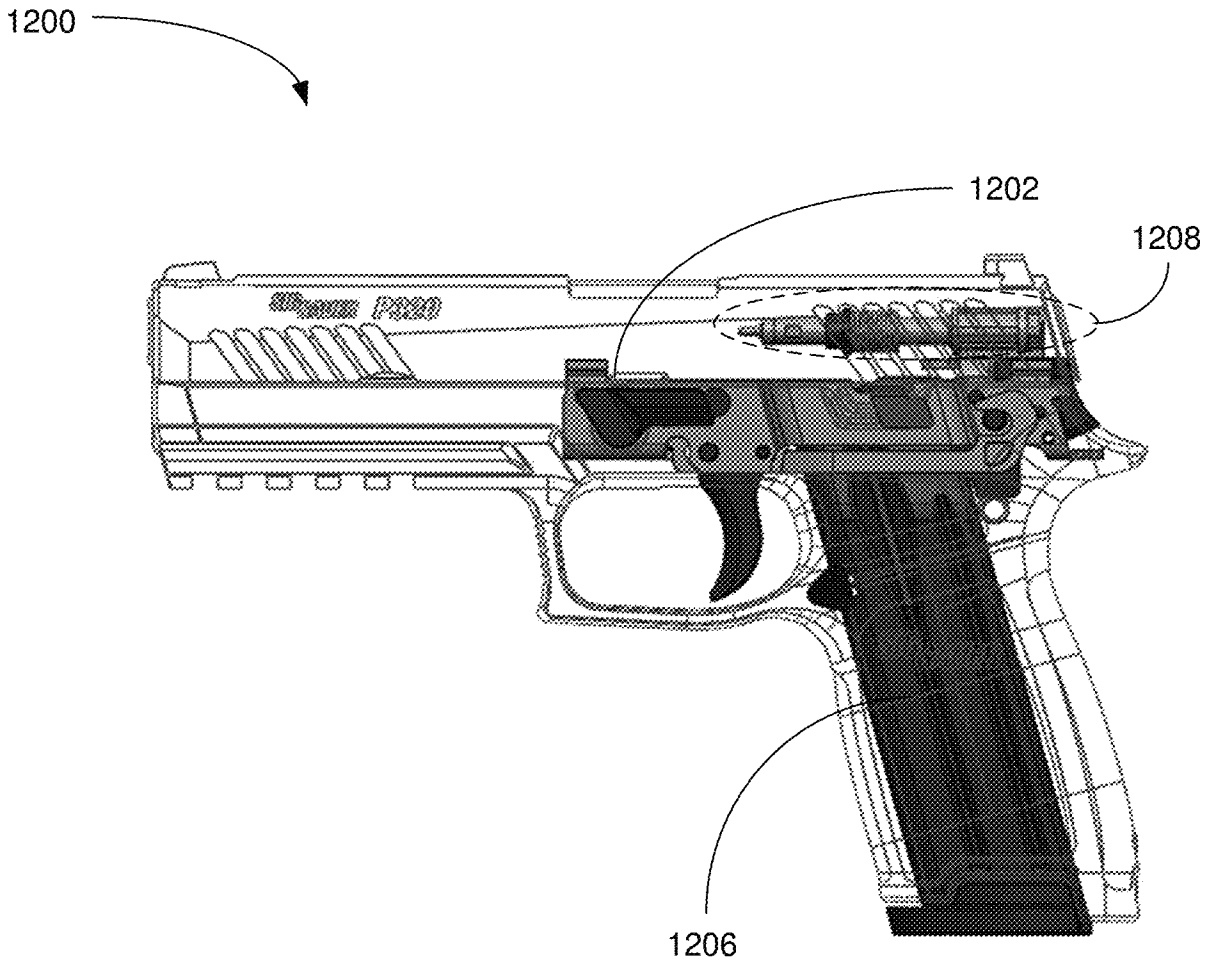
FIGS. 12A-12C are diagrams showing an alternative exemplary illustration for modifying a semiautomatic weapon using a kit and an existing FCU in accordance with one embodiment of the present invention.
Figure 12B:
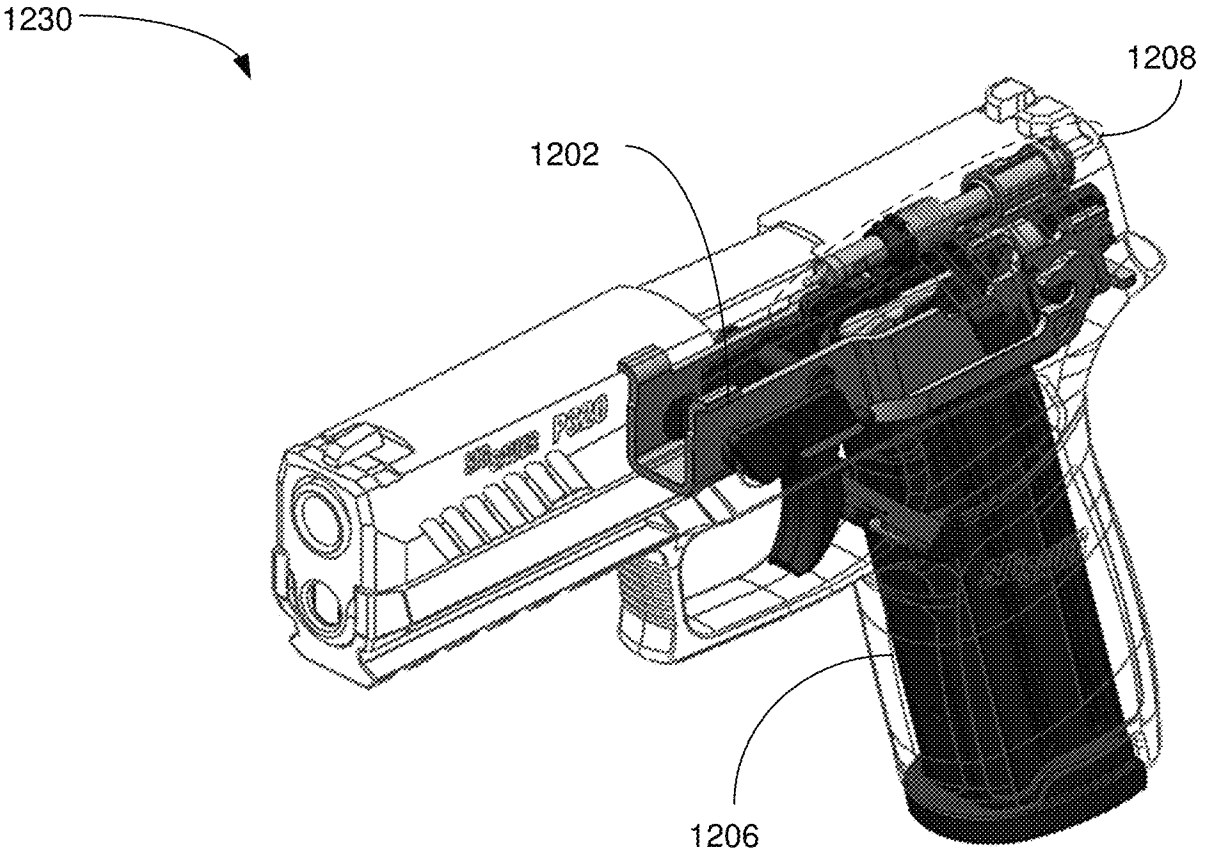
Figure 12C:
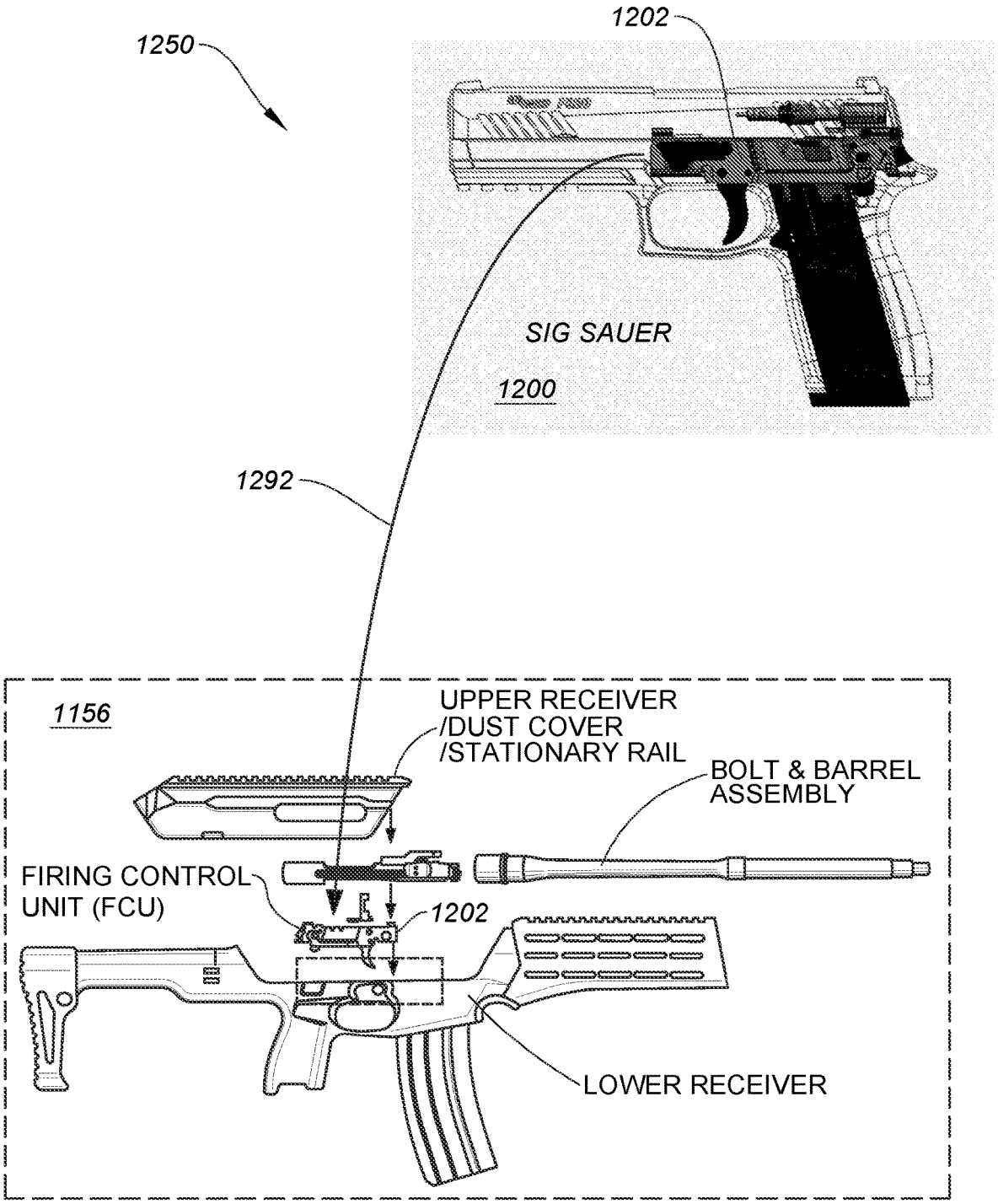

FIGS. 12A-12C are diagrams showing an alternative exemplary illustration for modifying a semiautomatic weapon using a kit and an existing FCU in accordance with one embodiment of the present invention. FIG. 12A illustrates a see-through view of SIG SAUER P320™ type of handgun 1200 containing a slide assembly or slide, FCU 1202, firing pin 1208, and magazine 1206. FCU 1202, which is detachable, is a serialized trigger mechanism capable of firing a bullet or ammo when its trigger is pulled. FCU 1202 is configured and fabricated for SIG SAUER P320™ and FCU 1202 can be disassembled or removed as a whole firing unit from the receiver of SIG SAUER P320™. In one example, FCU 1202 includes a serial number which is used to determine the identity of firearm.

An advantage of using FCU 1202 of SIG SAUER P320™ is to allow a user to modify a handgun of SIG SAUER P320™ into a semiautomatic rifle using a kit.

FIG. 12B illustrates an alternative see-through view of SIG SAUER P320™ of handgun 1230 containing a slide assembly or slide, an FCU 1202, a firing pin 1208, and a magazine 1206. FCU 1202, in one aspect, is structured as a removable unit that can be removed from the receiver of SIG SAUER P320™. It should be noted that the underlying concept of the exemplary embodiment(s) of the present invention would not change if one or more components (or elements) were added to or removed from FIG. 12B.

FIG. 12C illustrates a conversion of an operable handgun 1100 to a carbine-like rifle using a firearm kit 1156 in accordance with one embodiment of the present invention. Handgun 1100, in one example, is a SIG SAUER P320™ containing an FCU 1202 which can be disassembled from SIG SAUER P320™ 1200. FCU 1202, in one embodiment, is subsequently refitted or inserted into FCU housing of kit 1156 as indicated by numeral 1292. It should be noted that FCU housing is specifically designed, configured, and structured to be used in SIG SAUER P320™ 1200. Once FCU 1120 is inserted into FCU housing, Kit 1156 is modified into an operational carbine-like rifle or semiautomatic firearm.

Figure 13A:
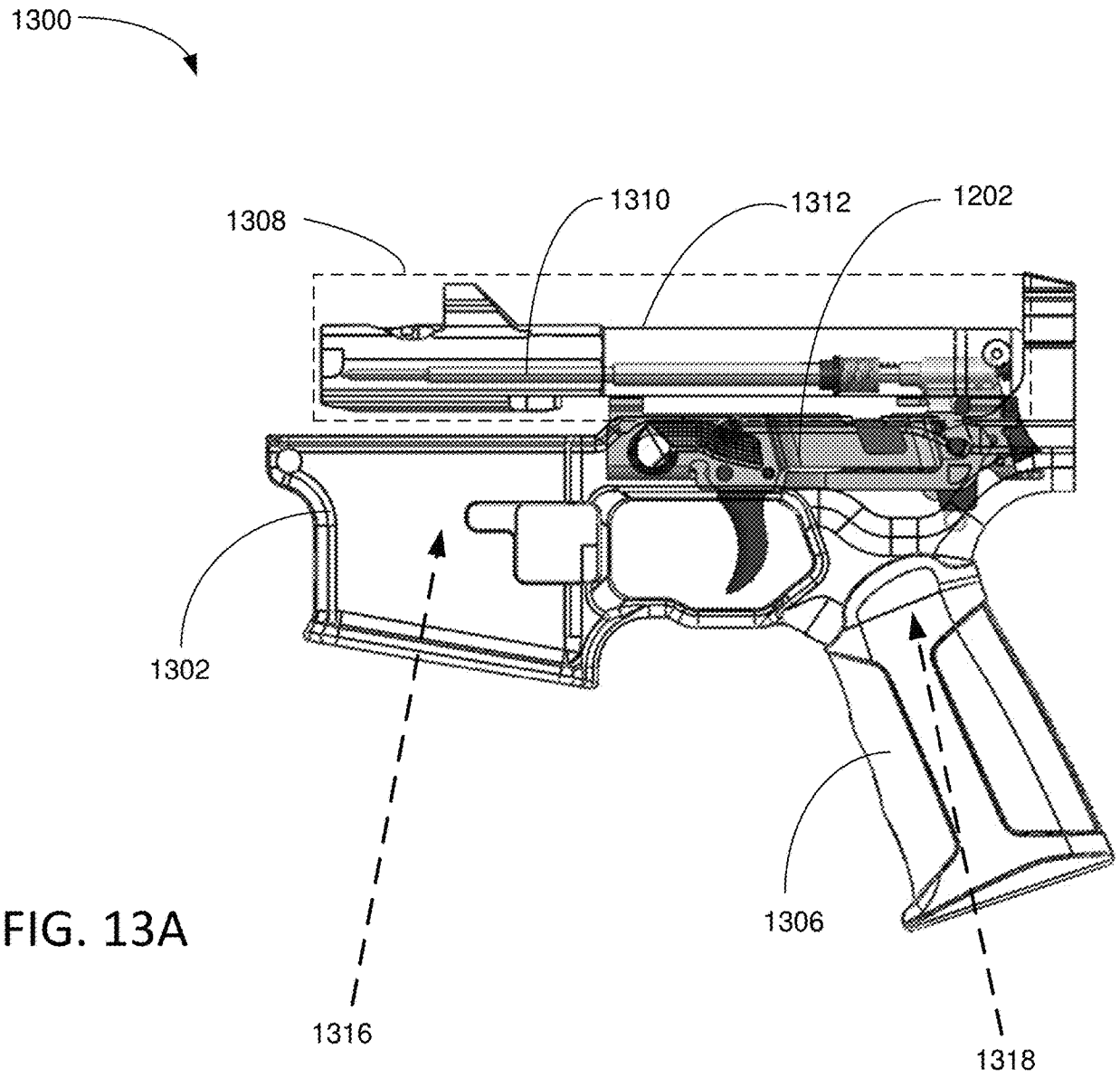
FIGS. 13A-13C are diagrams illustrating a firearm kit containing adjustable firing slide ("AFS") facilitating firing of bullets via an existing FCU in accordance with one embodiment of the present invention.

FIG. 13A is a diagram illustrating a detailed view of a firearm kit containing adjustable firing slide ("AFS") facilitating firing of bullets via an existing FCU in accordance with one embodiment of the present invention. Diagram 1300 illustrates a portion of a kit having AFS 1308, grip module 1306, and inserted FCU 1202. Grip module 1306, in one embodiment, includes a magazine port 1302 which is used to receive ammunition from a magazine (not shown in FIG. 13A) when it is inserted into magazine port 1302. It should be noted that the underlying concept of the exemplary embodiment(s) of the present invention would not change if one or more components (or elements) were added to or removed from FIG. 13A.

AFS 1308, in one embodiment, includes a slide 1312 and an adjustable extended pin ("AEP") 1310. Slide 1312, in one example, is a bolt carrier moving horizontally alongside of AEP 1310 for facilitating and/or adapting firing ammunition in front of trigger. AEP 1310 is configured to facilitate firing ammunition in front of the trigger of FCU 1202 as indicated by arrow 1316. It should be noted that FCU 1202 is originally designed for a handgun which usually receives ammunition via the grip of handgun which is generally located behind the trigger of FCU 1202 as indicated by arrow 1318. In one embodiment, AFP 1308 is configured to facilitate firing ammunition through magazine port 1302 via FCU 1202. In other words, AFP 1308 uses AEP 1310 to move the firing location from behind trigger to in-front-of trigger as indicated by arrows 1316-1318.

Figure 13B:
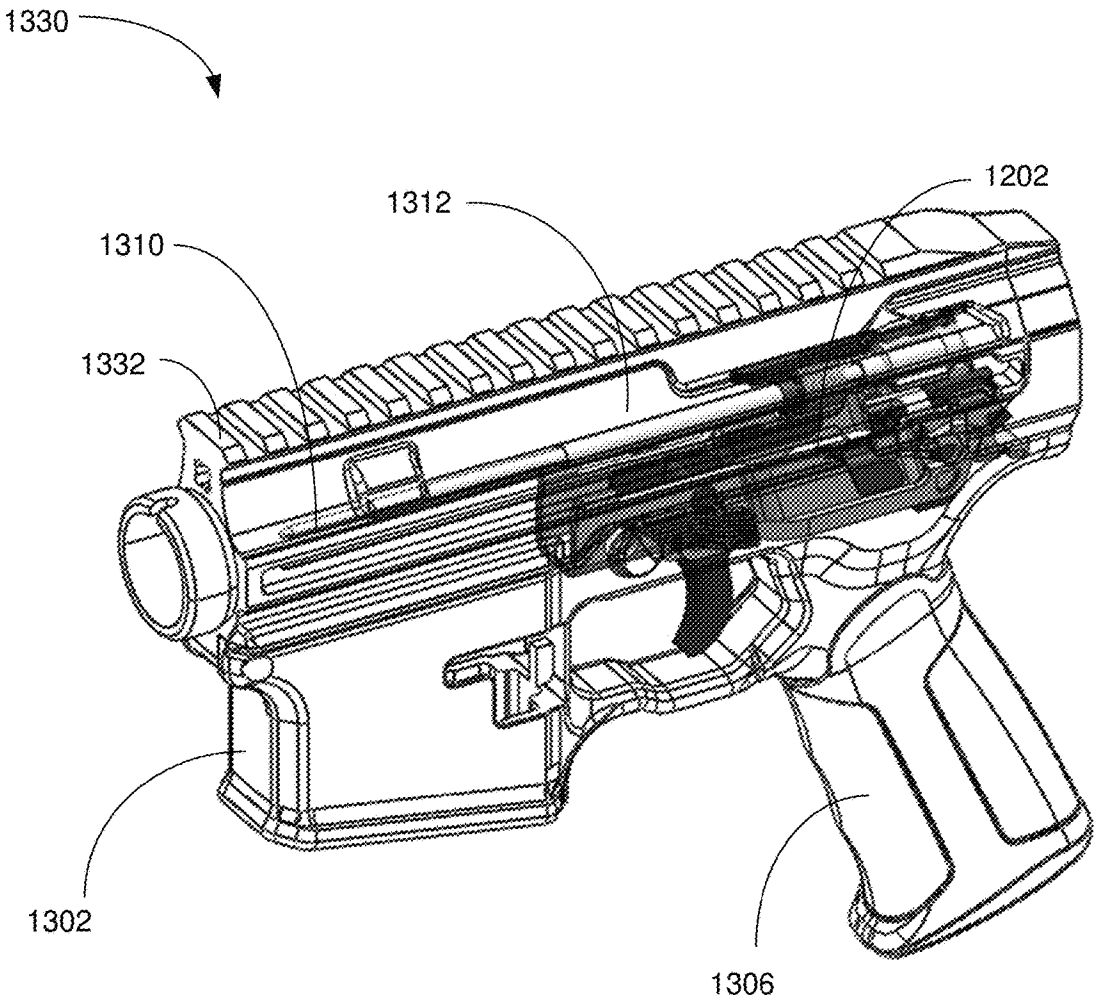

FIG. 13B is a diagram 1330 illustrating an alternative view of a firearm kit containing AFS facilitating firing of bullets via an existing FCU in accordance with one embodiment of the present invention. Diagram 1330 is similar to Diagram 1300 shown in FIG. 13A except that diagram 1330 includes an upper receiver 1332. Upper receiver 1332 is used to cover grip module 1306 enclosing AFS and FCU 1202. It should be noted that the underlying concept of the exemplary embodiment(s) of the present invention would not change if one or more components (or elements) were added to or removed from FIG. 13B.

Figure 13C:
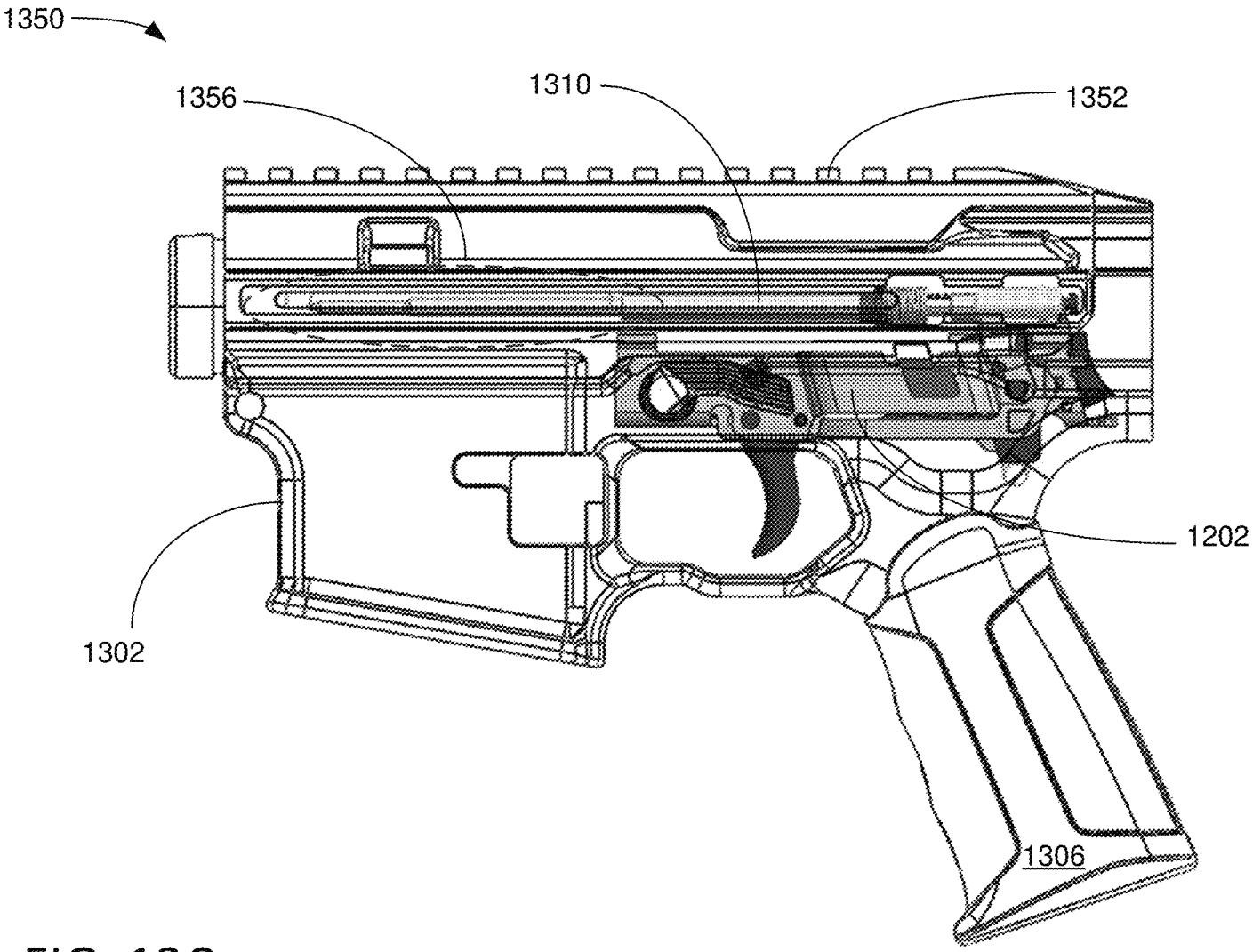

FIG. 13C is a diagram 1350 illustrating an alternative view of a firearm kit containing AFS facilitating firing of bullets via FCU 1202 in accordance with one embodiment of the present invention. Diagram 1350 is similar to Diagram 1300 shown in FIG. 13A except that diagram 1350 includes an upper receiver 1352. Upper receiver 1352 is used to enclose AFS and inserted FCU 1202. Depending on the applications or grip modules, an adjustable pin 1356 of AEP 1310 can be adjusted depending on the design of kit as well as size of ammunition.

A firearm assembly, in one aspect, includes an existing FCU and a firearm assembly kit configured to expel one or more bullets. An existing FCU such as FCU 1202 is disassembled from a handgun. The handgun is defined as a firearm operable by one hand and able to firing a bullet when a trigger of FCU is pulled. The existing FCU, for example, can be disassembled from SIG SAUER® P320™ handgun 1200. Alternatively, the existing FCU can be removed from a GLOCK 17™ handgun wherein FCU is originally manufactured for GLOCK 17™ handgun. In one example, FCU contains an original serial number for the purpose of identifying the firearm.

The firearm assembly kit is capable of housing FCU to form an operable firearm resembling a semiautomatic rifle which generally requires two hand to operate. The firearm assembly kit includes a grip module, an EFS, a rifle-shaped rear attachment, a bolt and barrel assembly, and an upper receiver. The rifle-shaped rear attachment is used to couple to a rear stabilizing connector of the firearm assembly kit for enhancing stability. The bolt and barrel assembly which is situated above a magazine port inside of the rifle-shaped rear attachment behind the FCU for facilitating firing of the object. The upper receiver is configured to couple to the grip module for enclosing the FCU and the bolt and barrel assembly between the upper receiver and the grip module.

The grip module, in one aspect, includes a handgrip, an FCU housing, a trigger guard, and a magazine port wherein the trigger guard is situated between the handgrip and the magazine port. The magazine port is located in front of the handgrip away from a user. The magazine port, in one example, is located in front of the handgrip for receiving a magazine which holds ammunition. The FCU housing is configured to receive the FCU and facilitates a trigger of the FCU to passing through the FCU housing into the trigger guard. The grip module also contains a serial number window which is located in such a way that when an FCU is inserted in the FCU housing of the grip module, the original serial number of the FCU shows through the serial number window.

The EFS is coupled to the FCU when the FCU is inserted in the FCU housing. A function of EFS is to facilitate firing of bullets passing through a magazine inserted in the magazine port via an extended firing pin. In one aspect, the EFS includes an adjustable firing pin configured to extend firing location from a handgrip area which is behind a trigger to the magazine port which is in front of the trigger away from the user. The FCU, removable from a single hand operable handgun, is configured to include a serialized trigger mechanism via a striker able to facilitate launching a directional object when a trigger of the FCU is pulled.

The firearm assembly, in one example, modifies a handgun into a semiautomatic weapon resembling a carbine rifle capable of firing bullets. Alternatively, if the kit resembles a semiautomatic rifle of AR 15, the firearm assembly should look like an AR 15 like firearm.

Figure 14A:
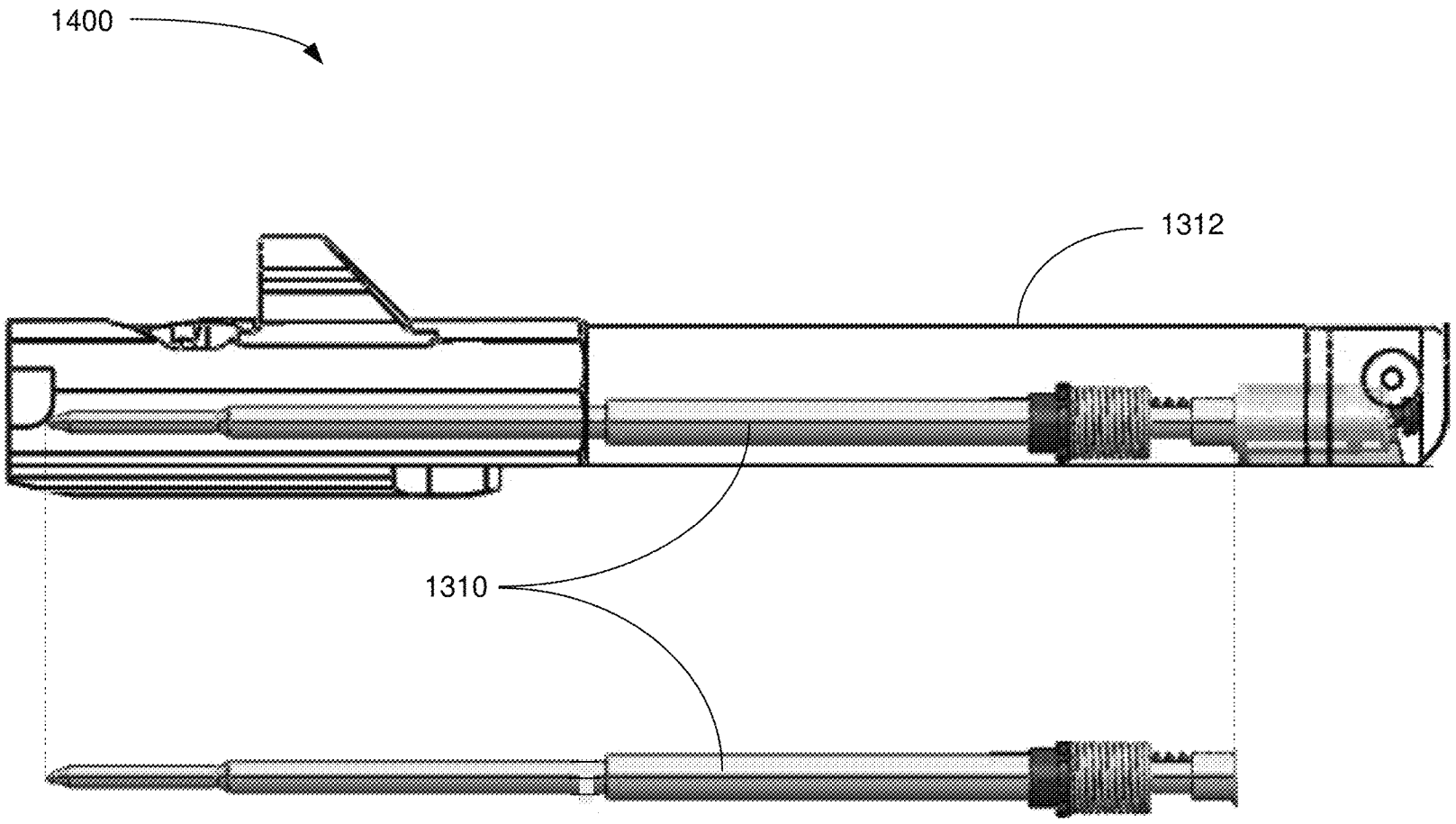
FIGS. 14A-14C are diagrams illustrating exemplary AFS and AEP used in a firearm kit able to facilitate firing ammunition in accordance with one embodiment of the present invention.
Figure 14B:
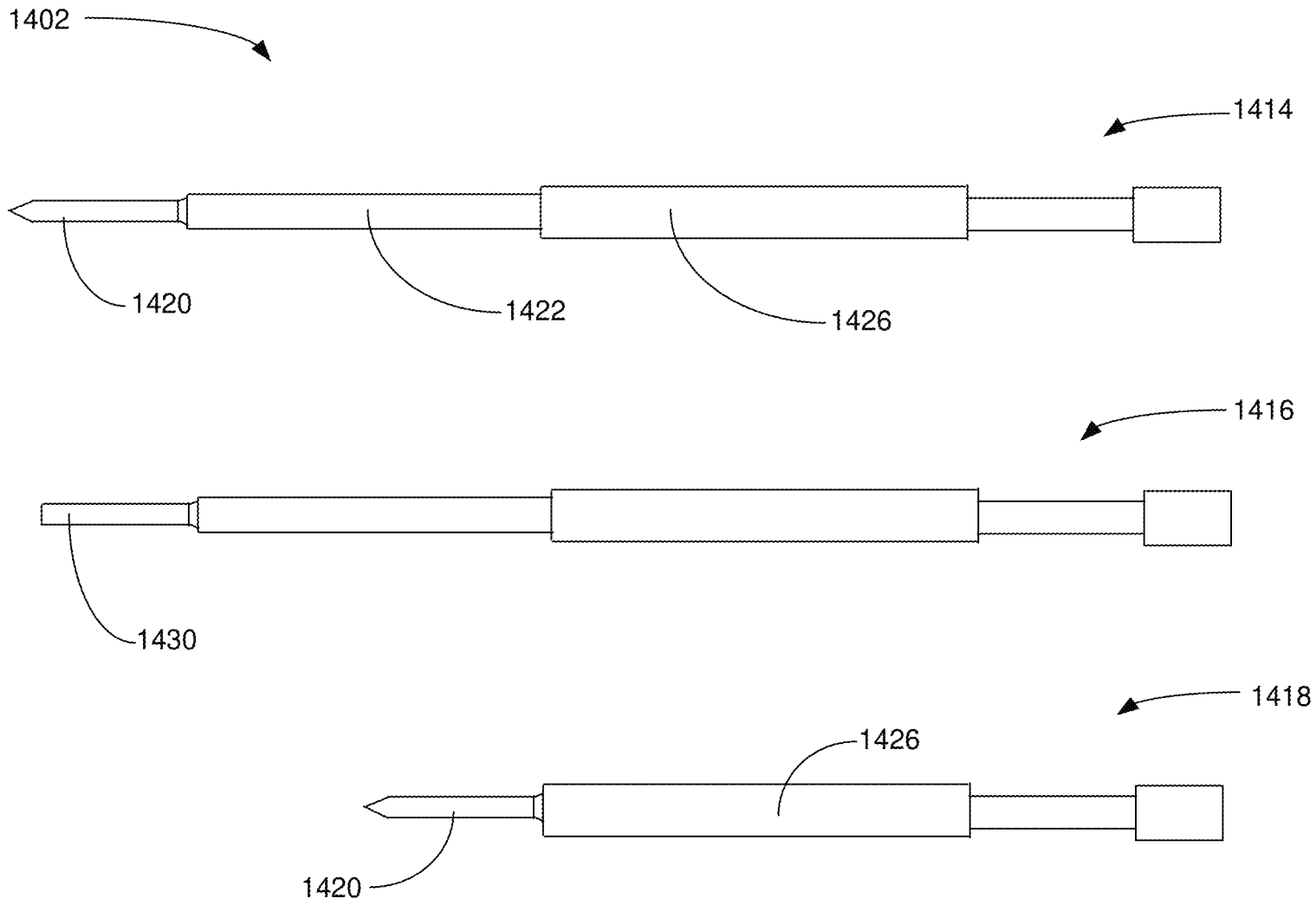
Figure 14C:
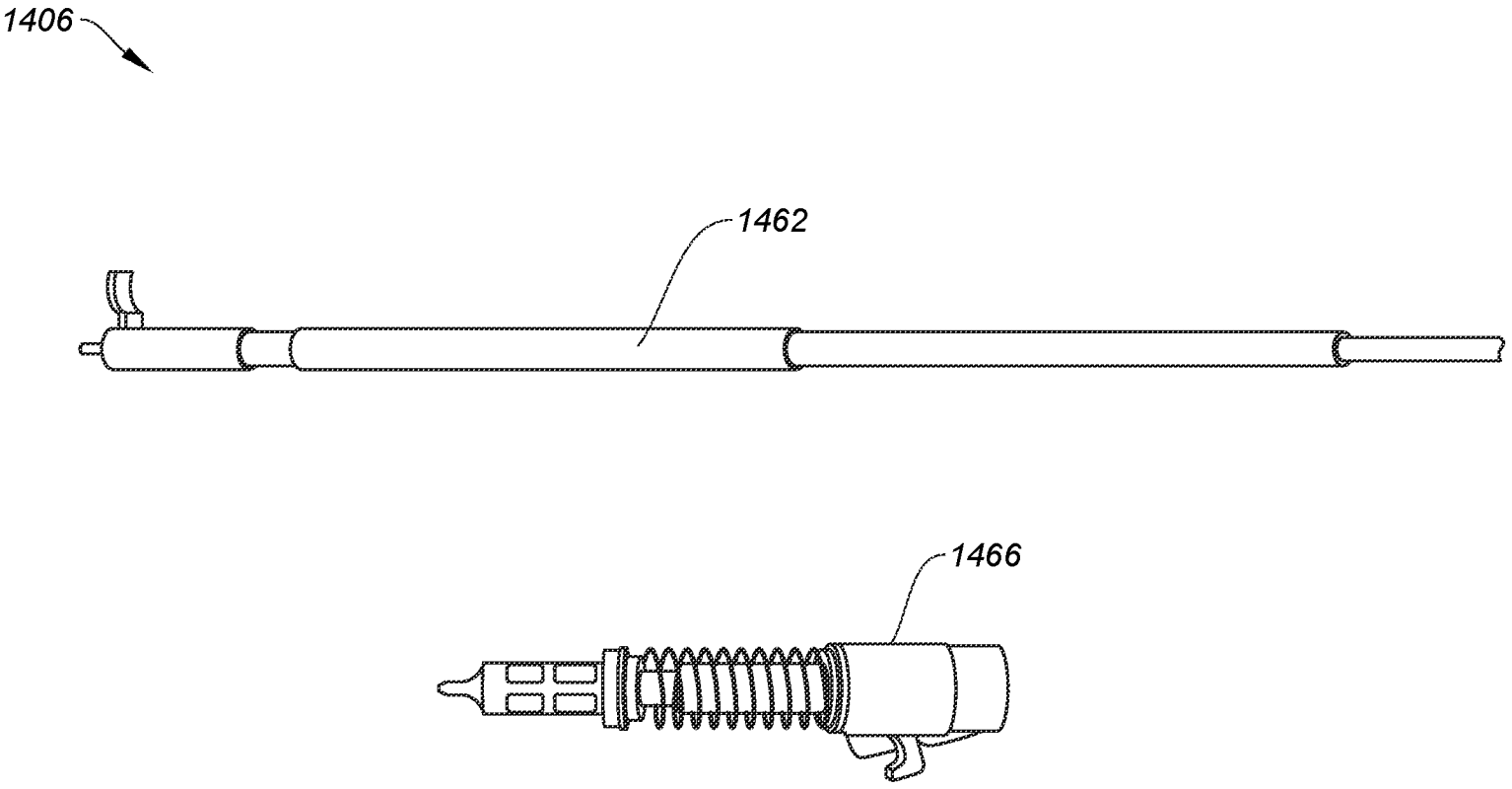

FIGS. 14A-14C show diagrams 1400-1406 illustrating exemplary AFS and AEP used in a firearm kit able to facilitate firing of ammunition in accordance with one embodiment of the present invention. Diagram 1400 illustrates slide 1312 wherein AEP 1310 is separated from slide 1312. Diagram 1402 illustrates three different AEPs 1414-1418. AEP 1414, in one aspect, includes a head 1420, an extension 1422, and a body 1426. Depending on the size of ammunition, head 1420 can be switched or changed accordingly. For example, AEP 1416 changes its head by replacing head 1430 with head 1420 having a large striking point. Note that a larger striking point should be more suitable for launching a large sized ammunition. Diagram 1418 illustrates a relatively shorter AEP since extension 1422 has been removed in response to one or more reasons such as change of a grip module. Diagram 1406 illustrates AEPs 1462-1466 with different lengths applicable to different applications.

Figure 15A:
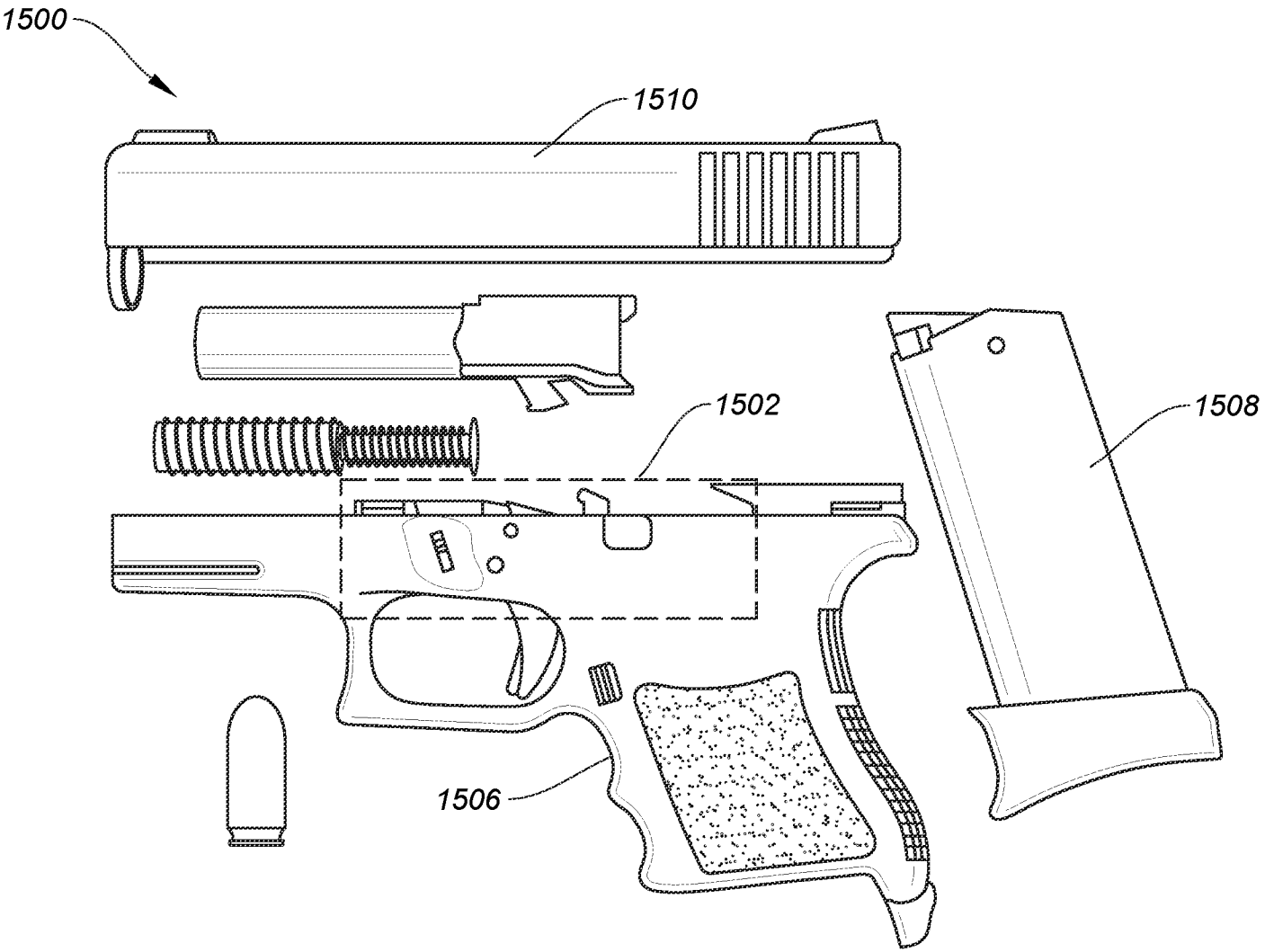
FIGS. 15A-15B are diagrams illustrating an alternative embodiment of firearm assembly using a handgun and an existing FCU in accordance with one embodiment of the present invention.

FIG. 15A is a diagram 1500 illustrating an alternative embodiment of firearm assembly using a handgun and an existing FCU in accordance with one embodiment of the present invention. Diagram 1500 illustrates a Glock 17™ handgun containing a slide 1510, grip 1506, FCU 1502, and magazine 1508. Note that FCU 1502, in one embodiment, is a firing unit which is modified and/or converted from Glock 17™ frame. Glock 17™ handgun may include other components, such as, but not limited to, barrel and recoil spring assembly. In one aspect, FCU 1502 can be removed from Glock 17™ handgun for facilitating firearm modification.

Figure 15B:
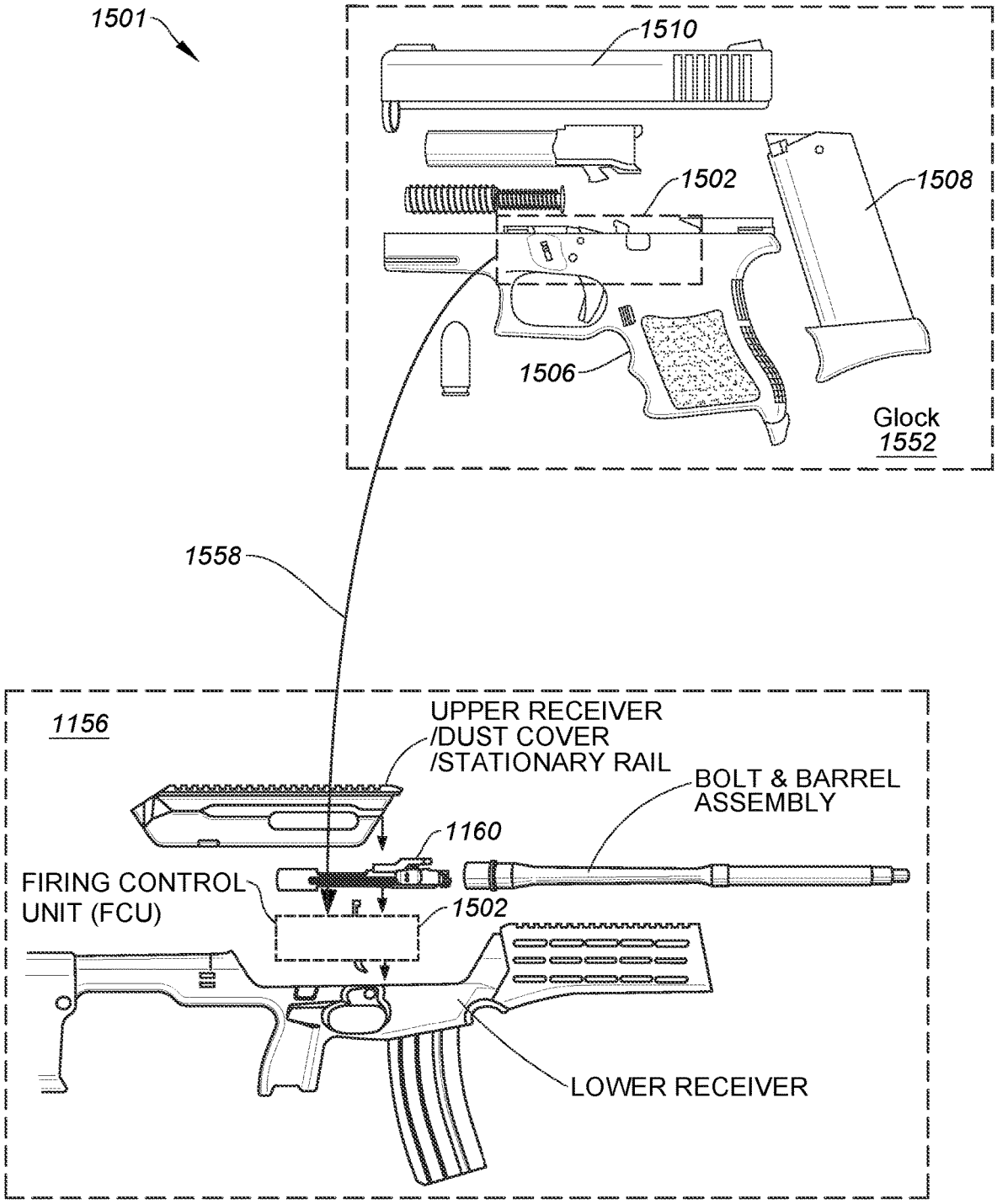

FIG. 15B illustrates a modification of converting an operable Glock 17™ handgun 1552 into a carbine-like rifle using a firearm kit 1156 in accordance with one embodiment of the present invention. FCU 1502, in one aspect, can be disassembled from Glock 17™ handgun 1552. FCU 1502, in one embodiment, is subsequently refitted into FCU housing of kit 1156 as indicated by numeral 1558. It should be noted that FCU housing is specifically designed, configured, and structured to receive FCU 1502. Once FCU 1502 is inserted into FCU housing, Kit 1156 is modified or converted into an operational carbine-like rifle or semiautomatic weapon.

In an alternative application, a semiautomatic firearm assembly able to expel an object includes a kit containing a grip module and one or more FCUs. The FCU is configured to be a serialized trigger mechanism capable of initiating launching a directional object when a trigger of the FCU is pulled. The grip module, in one aspect, contains a grip, first FCU housing, second FCU housing, and rear stabilizing connector. The first FCU housing is situated in front of a trigger and the second FCU housing is situated above the trigger. The first and second FCU housings are used to house two FCUs for facilitating launching one or more different types of ammunition such as bullets and grenades.

The exemplary embodiment of the present invention includes various processing steps, which will be described below. The steps of the embodiment may be embodied in machine or computer-executable instructions.

Figure 16:
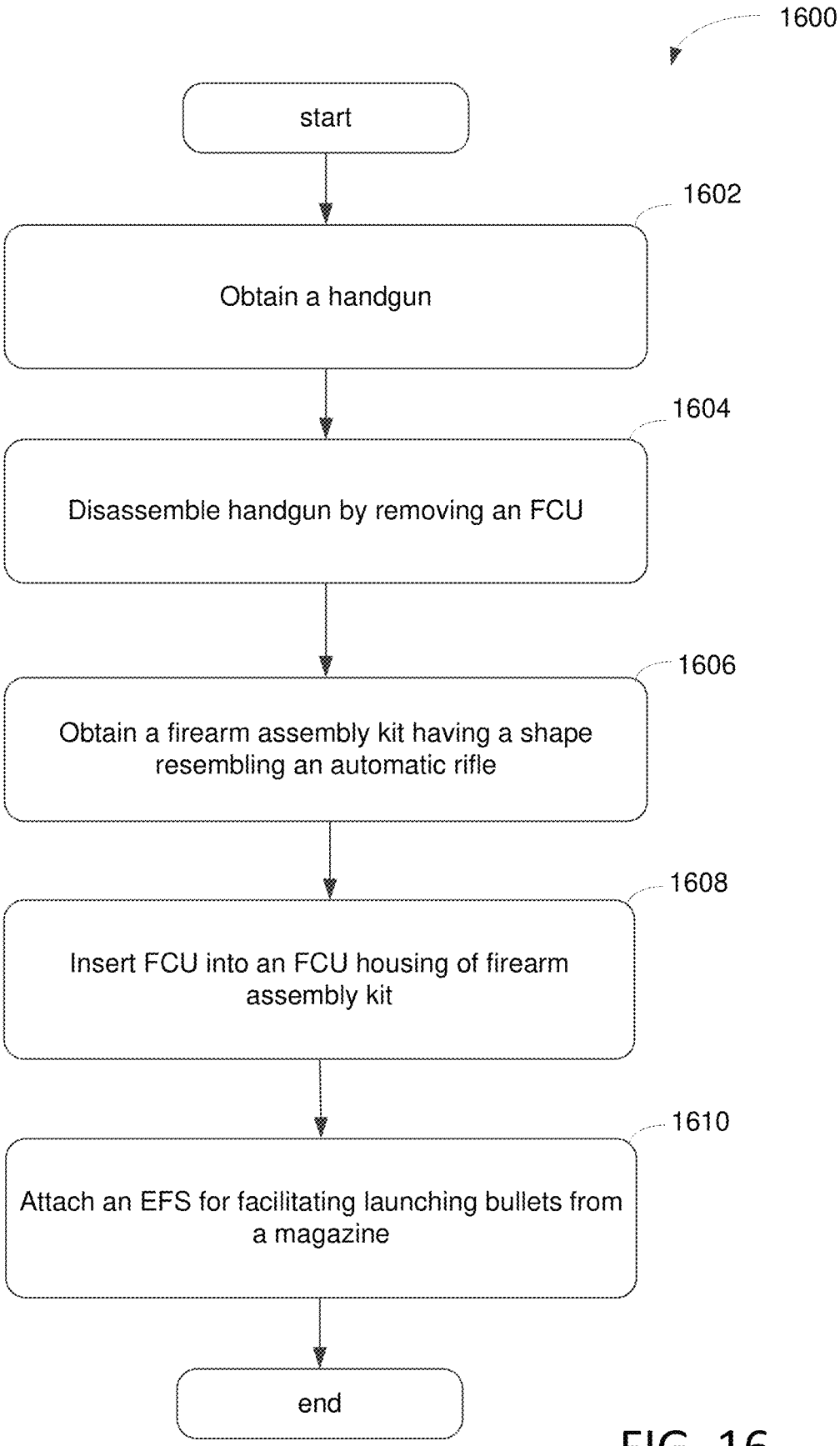
FIG. 16 is a diagram illustrating a flowchart showing a process of assembling a firearm using a kit and an FCU from a handgun in accordance with one embodiment of the present invention.

FIG. 16 is a flowchart 1600 illustrating a process of assembling a firearm using a kit and an existing FCU from a handgun in accordance with one embodiment of the present invention. At block 1602, a process capable of inserting an existing FCU into a firearm assembly kit obtains a handgun which is operable with a single hand for holding and firing of ammunition.

At block 1604, the handgun is disassembled by removing an FCU from the body of handgun. In one aspect, the handgun is a SIG SAUER P320™. After releasing and removing the magazine from the handgrip of SIG SAUER P320™, a slide is removed from the receiver of SIG SAUER P320™. The FCU is subsequently separated from the receiver of SIG SAUER P320™.

At block 1606, a firearm assembly kit having a shape resembling an automatic rifle is obtained. Notice that the firearm assembly kit alone cannot launch or fire ammunition because the kit does not have an FCU.

At block 1608, the FCU which is disassembled from the handgun is inserted into an FCU housing of the firearm assembly kit.

At block 1610, an EFS is attached to the grip module over the FCU for facilitating launching bullets supplied by a magazine which is attached or inserted to a magazine port. The magazine port is situated in front of a trigger guard of the firearm assembly kit away from the operator. The EFS, in one example, can be adjusted relating to the size of extended firing pin in accordance with the dimension of ammunition used. For example, different sizes of bullets may require different sizes of firing pins.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A firearm assembly configured to expel a bullet, comprising:

a firing control unit ("FCU") disassembled from a handgun which is operable by one hand with ammunition situated inside of grip and configured to facilitate firing a bullet; and a firearm assembly kit configured to house the FCU to form an operable firearm resembling a semiautomatic rifle, the firearm assembly kit including:

a grip module having a handgrip, an FCU housing, a trigger guard, and a magazine port, wherein the trigger guard is situated between the handgrip and the magazine port which is located in front of the handgrip away from a user, an adjustable firing slide ("AFS"), including an extended firing pin ("EFP") containing a head portion, an extension portion, and a body portion, wherein the extension portion is removably attached to the body portion for extending the EFP from the FCU to the magazine port, coupled to the FCU when the FCU is inserted in the FCU housing and facilitates firing of bullets passing through a magazine inserted in the magazine port via the EFP.

2. The assembly of claim 1, wherein the FCU housing is configured to receive the FCU which is originally manufactured for a handgun and allow a trigger of the FCU to passing through the FCU housing and into the trigger guard.

3. The assembly of claim 1, wherein the FCU is disassembled from SIG SAUER® P320™ semi-automatic handgun.

4. The assembly of claim 1, wherein the FCU is manufactured for a GLOCK 17™ semi-automatic handgun.

5. The assembly of claim 1, wherein the AFS includes an adjustable firing pin configured to extend firing location from a handgrip area which is behind a trigger to the magazine port which is in front of the trigger away from the user.

6. The assembly of claim 1, wherein the FCU, removable from a single hand operable handgun, is configured to include a serialized trigger mechanism via a striker able to facilitate launching a directional object when a trigger of the FCU is pulled.

7. The assembly of claim 1, wherein the firearm assembly kit includes:

a rear attachment coupled to a rear stabilizing connector of the firearm assembly kit for enhancing stability; and a bolt and barrel assembly coupled to the rear attachment for facilitating firing of the object.

8. The assembly of claim 7, wherein the firearm assembly kit includes an upper receiver configured to couple to the grip module for enclosing the FCU and the bolt and barrel assembly between the upper receiver and the grip module.

9. The assembly of claim 1, wherein the FCU contains an original serial number for identification purposes.

10. The assembly of claim 9, wherein the grip module contains a serial number window which is located in such a way that when the FCU is inserted in the FCU housing of the grip module, the original serial number shows through the serial number window.

11. A semiautomatic rifle resembling a carbine rifle configured to fire bullets comprising the firearm assembly of claim 1.

12. A semiautomatic rifle resembling an ArmaLite rifle 15 ("AR 15") or AR 15 pistol configured to fire bullets or projectiles comprising the firearm assembly of claim 1.

13. A method for inserting a firing control unit ("FCU") into a firearm assembly kit which resembles a semiautomatic rifle, the method comprising:

obtaining an FCU designed to be embodied in a handgun that is operable with a single hand and configured to fire a projectile;

disassembling the handgun by removing an FCU from the grip module of the handgun;

obtaining a firearm assembly kit having a shape resembling an automatic rifle;

inserting the FCU into an FCU housing of the firearm assembly kit resembling an automatic rifle;

removability attaching an extension to a body to form an extended firing pin; and attaching an adjustable firing slide ("AFS") containing the extended firing pin to a grip module over the FCU housing allowing the extended firing pin to extend from the FCU housing to a magazine port of the grip module for facilitating launching bullets from a magazine attached to the magazine port situated in front of a trigger guard of the firearm assembly kit.

14. The method of claim 13, further comprising pulling the trigger of the FCU and allowing an extended firing pin to reach to a bullet from a magazine situated in front of the trigger guard.

15. The method of claim 13, wherein attaching the AFS further includes adjusting size of extended firing pin in response to dimension of ammunition.

16. The method of claim 13, wherein attaching the AFS further includes selecting size of ammunition.

17. The method of claim 13, wherein disassembling the handgun includes:

releasing and removing a magazine from a handgrip of a SIG SAUER P320™ semi-automatic handgun;

removing a slide from SIG SAUER P320™ semi-automatic handgun from a receiver of SIG SAUER P320™ semi-automatic handgun; and separating an FCU originally configured for SIG SAUER P320™ semi-automatic handgun from the receiver.

18. A method for inserting a firing control unit ("FCU") into a firearm assembly kit which resembles a semiautomatic rifle, the method comprising:

removing a slide from SIG SAUER P320™ semi-automatic handgun from a receiver of SIG SAUER P320™ semi-automatic handgun;

separating an FCU originally configured for SIG SAUER P320™ semi-automatic handgun from the receiver;

inserting the FCU into an FCU housing of a firearm assembly kit which resembles as an automatic rifle;

removability attaching an extension to a body to form an extended firing pin; and attaching an adjustable firing slide ("AFS"), containing the extended firing pin, to a grip module allowing the extended firing pin to extend from the FCU to a magazine port of the grip module for facilitating launching bullets from a magazine attached to the magazine port situated in front of a trigger guard of the grip module.

19. The method of claim 18, further comprising pulling the trigger of the FCU and allowing the extended firing pin to reach to a bullet from a magazine situated in front of the trigger guard.

20. The method of claim 18, wherein attaching the AFS further includes adjusting size of extended firing pin in response to dimension of ammunition.

21. The method of claim 18, wherein attaching the AFS further included selecting size of ammunition.

22. The method of claim 18, further comprising releasing and removing a magazine from a handgrip of a SIG SAUER P320™ semi-automatic handgun.

* * * * *